US005893408A

United States Patent [19]

Stark

[11] Patent Number: 5,893,408

[45] Date of Patent: Apr. 13, 1999

[54] REGENERATIVE HEAT EXCHANGER FOR DEHUMIDIFICATION AND AIR CONDITIONING WITH VARIABLE AIRFLOW

[75] Inventor: Walter Stark, Halesite, N.Y.

[73] Assignee: Nautica Dehumidifiers, Inc., Huntington, N.Y.

[21] Appl. No.: 08/511,378

[22] Filed: Aug. 4, 1995

[51] Int. Cl.[6] ..... F28F 3/06; F28F 1/10; F28F 9/26; F28F 3/14

[52] U.S. Cl. ..... 165/66; 165/100; 165/103; 165/166; 62/90; 62/93

[58] Field of Search ..... 165/166, 54, 66, 165/100, 103; 62/90, 93, 285

[56] References Cited

U.S. PATENT DOCUMENTS

| | | | |
|---|---|---|---|
| 821,518 | 5/1906 | Maslin et al. | 165/166 |
| 1,648,511 | 11/1927 | Solomiac | 165/166 |
| 1,727,124 | 9/1929 | Lonsdale | 165/166 |
| 1,827,099 | 10/1931 | Otis . | |
| 2,093,725 | 9/1937 | Hull . | |
| 2,093,968 | 9/1937 | Kettering . | |
| 2,128,641 | 8/1938 | Folsom . | |
| 2,577,359 | 12/1951 | Phipps | 165/166 |
| 3,165,152 | 1/1965 | Jones | 165/166 |
| 3,430,694 | 3/1969 | Cardell | 165/166 |
| 3,669,186 | 6/1972 | Schauls . | |
| 3,797,565 | 3/1974 | Fernandes | 165/166 |
| 3,880,231 | 4/1975 | Gauthier . | |
| 4,041,591 | 8/1977 | Noll et al. . | |
| 4,377,400 | 3/1983 | Okamoto et al. . | |
| 4,391,321 | 7/1983 | Thunberg . | |
| 4,428,205 | 1/1984 | Doderer . | |
| 4,461,344 | 7/1984 | Allen et al. . | |
| 4,517,810 | 5/1985 | Foley et al. . | |
| 4,761,966 | 8/1988 | Stark . | |
| 4,862,953 | 9/1989 | Granetzke et al. . | |
| 4,998,580 | 3/1991 | Guntly et al. . | |
| 5,205,347 | 4/1993 | Hughes . | |
| 5,275,233 | 1/1994 | Little . | |
| 5,279,360 | 1/1994 | Hughes et al. . | |

FOREIGN PATENT DOCUMENTS

| | | |
|---|---|---|
| 470100 | 12/1950 | Canada . |
| 818603 | 8/1959 | Canada . |
| 230568 | 4/1944 | France . |
| 2400734 | 7/1975 | Germany . |
| 2616556 | 5/1977 | Germany . |
| 3819535 | 12/1988 | Germany . |
| 5749793 | 3/1982 | Japan . |
| 828960 | 10/1979 | U.S.S.R. . |
| 909467 | 2/1982 | U.S.S.R. . |

*Primary Examiner*—John K. Ford
*Attorney, Agent, or Firm*—Dilworth & Barrese

[57] ABSTRACT

A heat exchanger for cooling and/or dehumidifying a stream of air which eliminates the need for a large air diffusing plenum chamber. Heat conducting channel walls serve as the heat exchange surface for precooling and reheating air during the dehumidification process. The cooling conduits laterally intersect the airflow channels in order to force cooling to occur both in the intake and exhaust airflow channels, and the airflow is redirected 180° in a small plenum chamber located at an end of the channels adjacent the cooling conduits. Adjustable dampers may be added for additional control of airflow in and out of intake and exhaust ports for the purpose of regulating the cooling and dehumidifying processes.

13 Claims, 15 Drawing Sheets

FIG. 8a
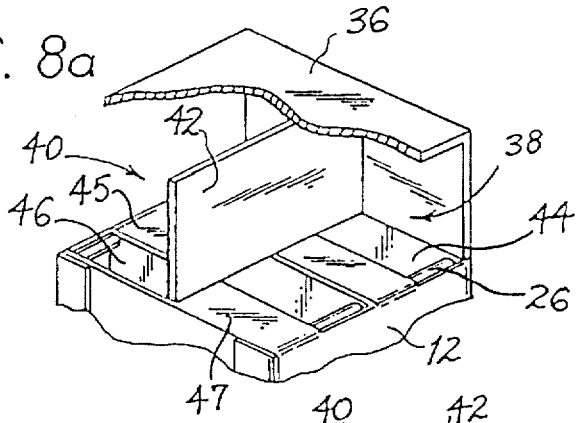
FIG. 7
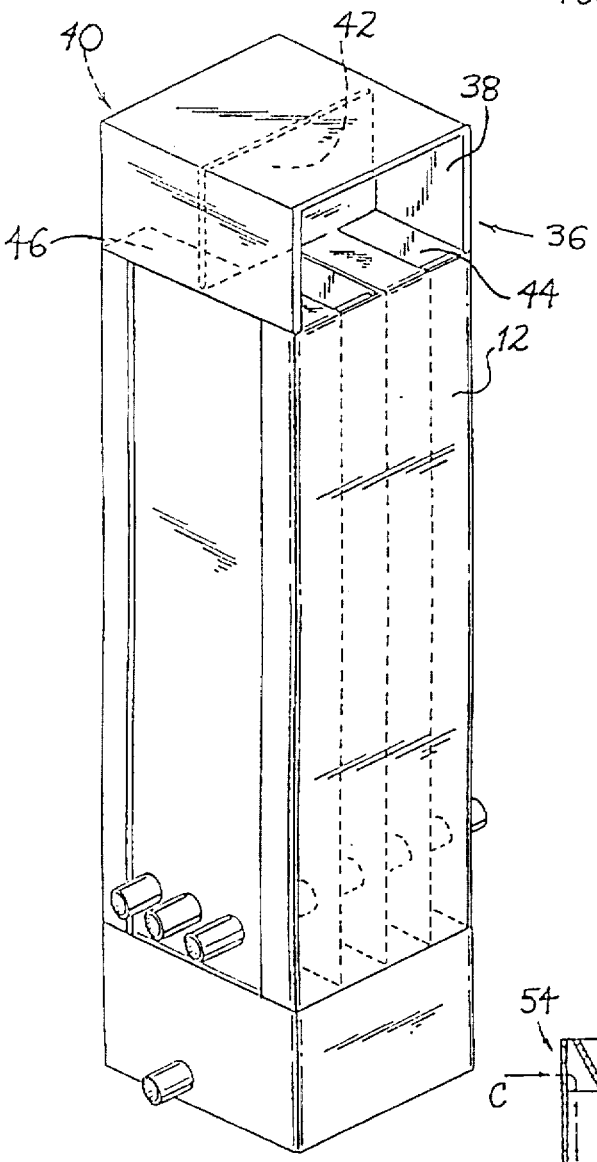
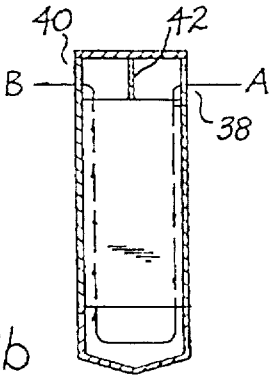
FIG. 8b
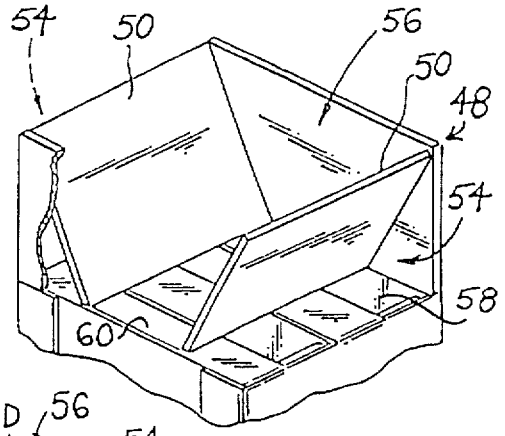
FIG. 9a
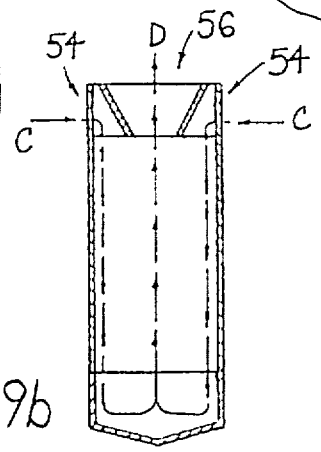
FIG. 9b FIG. 10
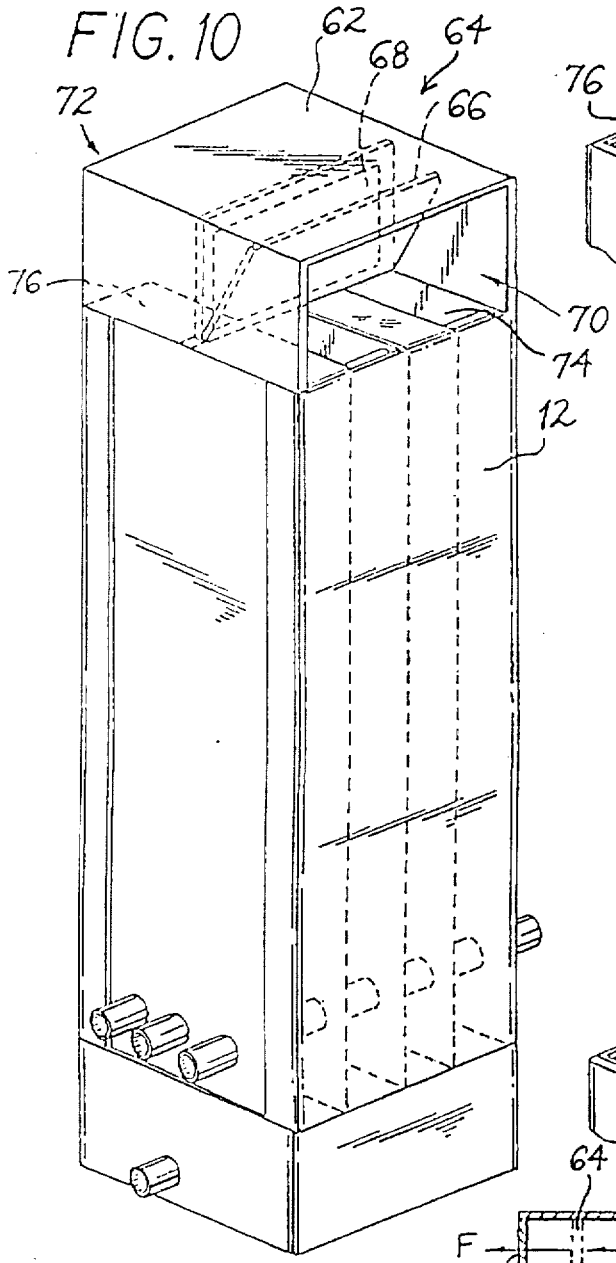
FIG. 11a
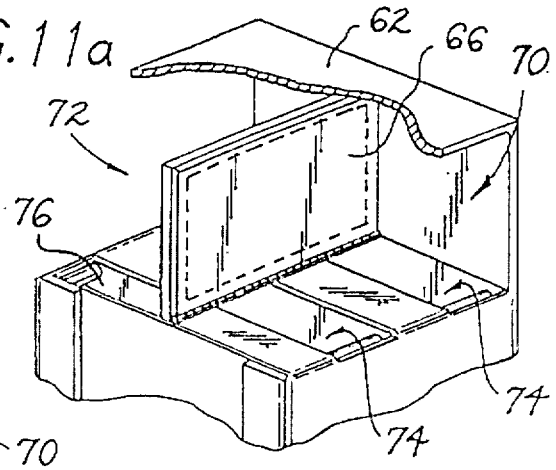
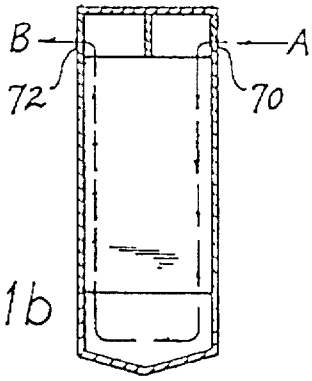
FIG. 11b
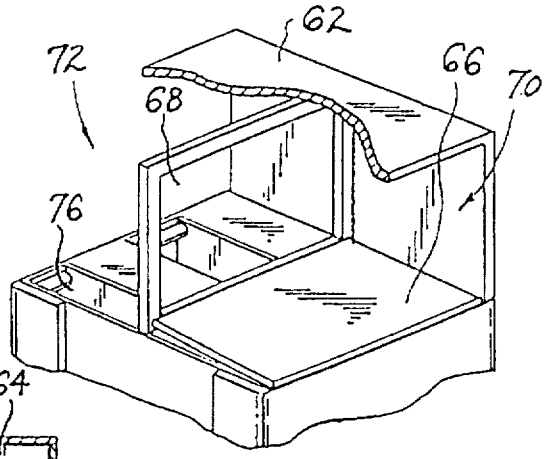
FIG. 12a
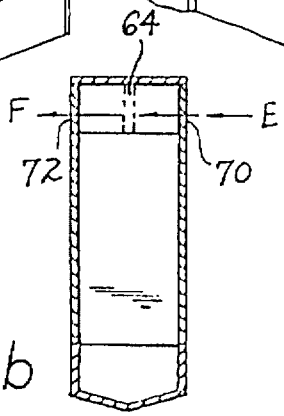
FIG. 12b

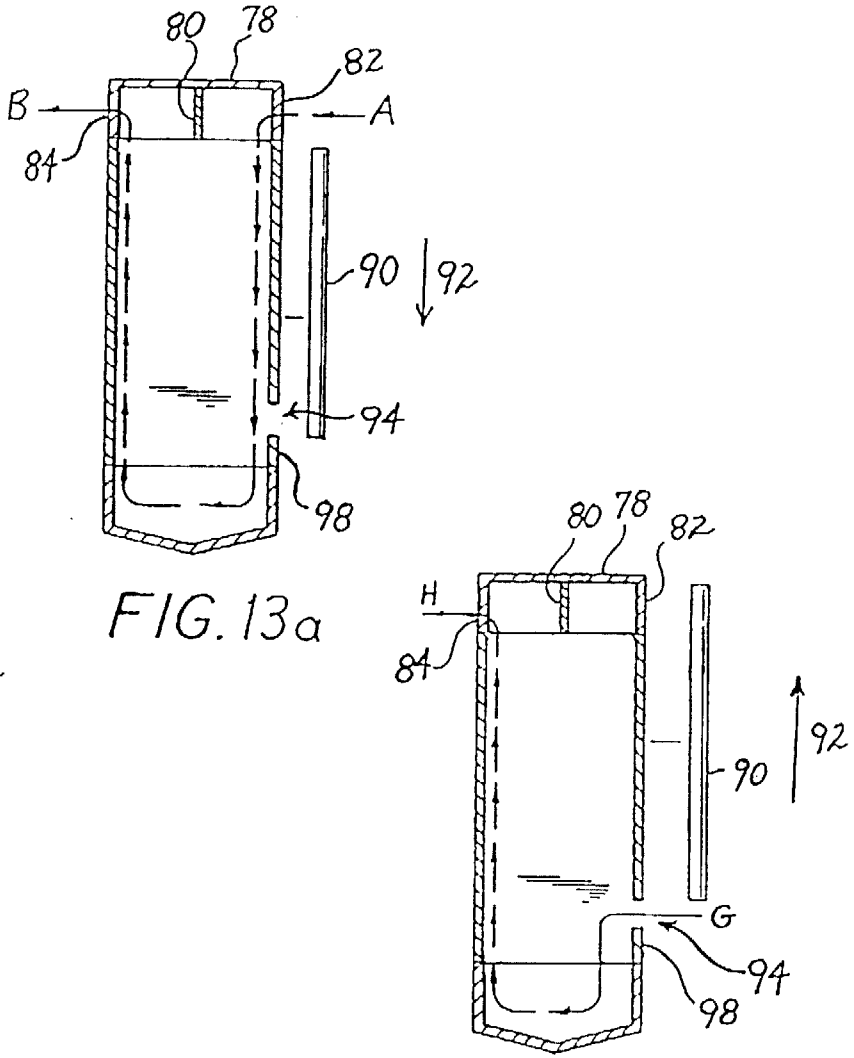
FIG. 13a
FIG. 13b
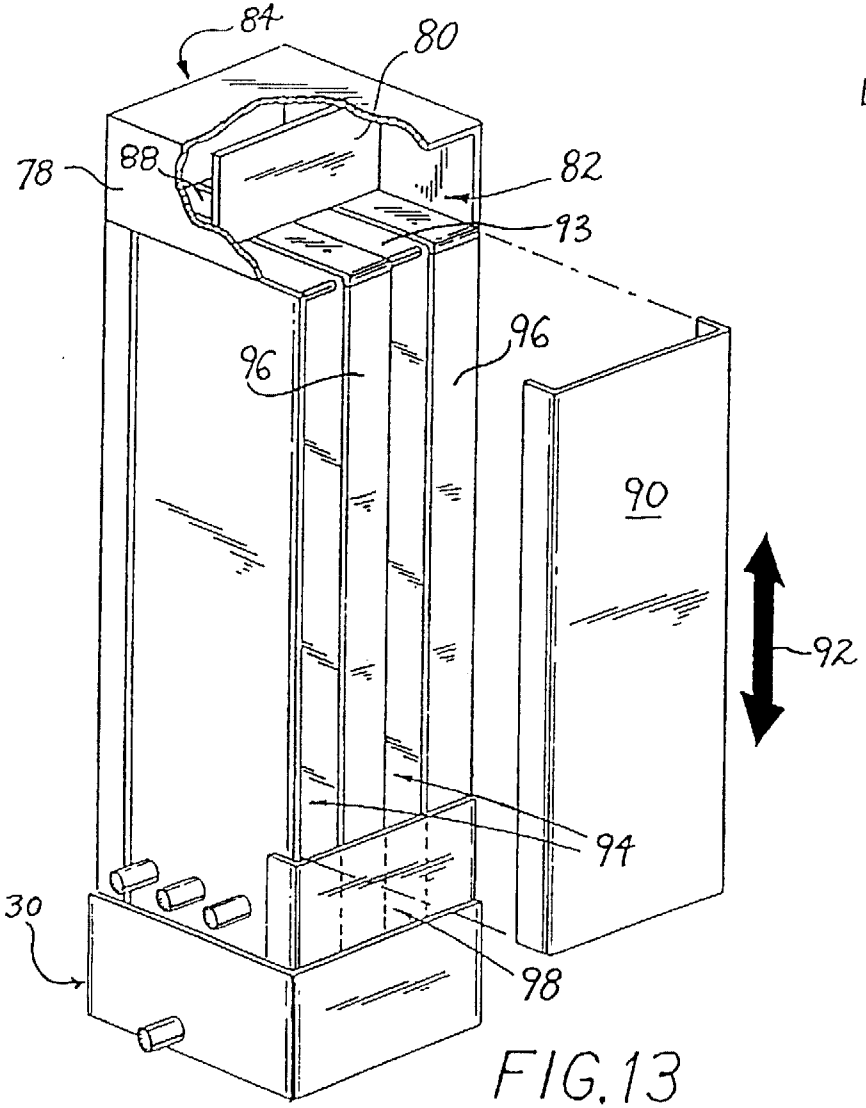
FIG. 13

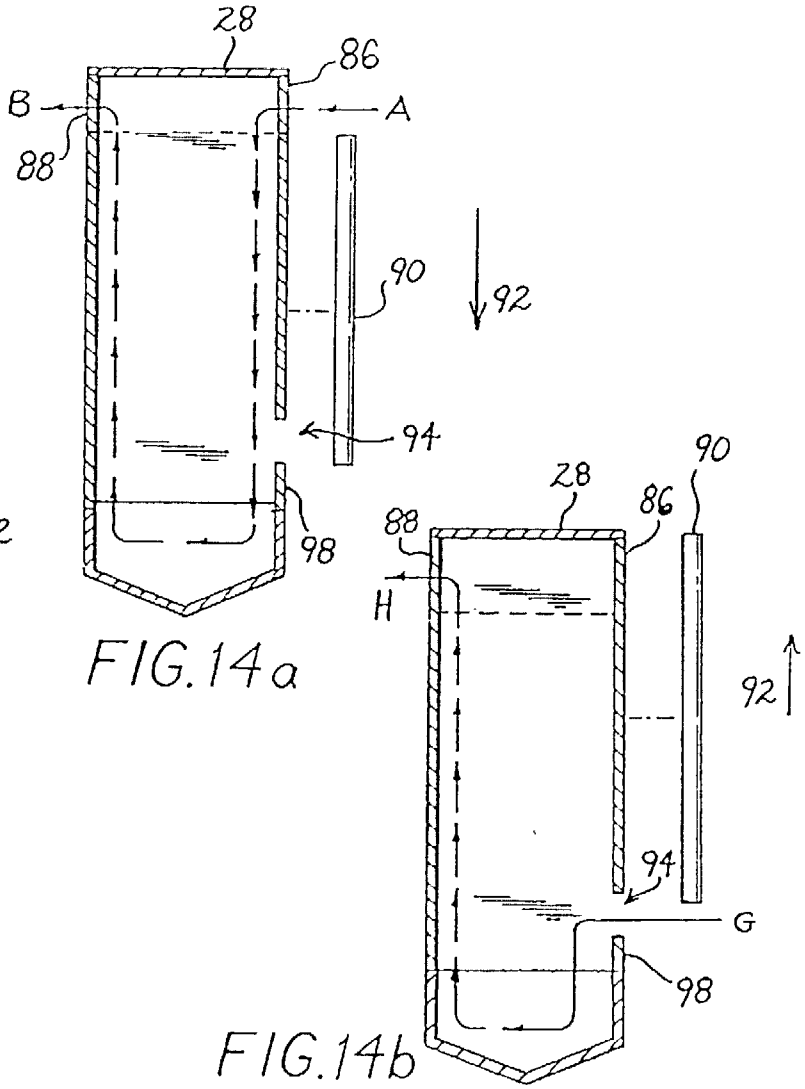
FIG. 14a
FIG. 14b
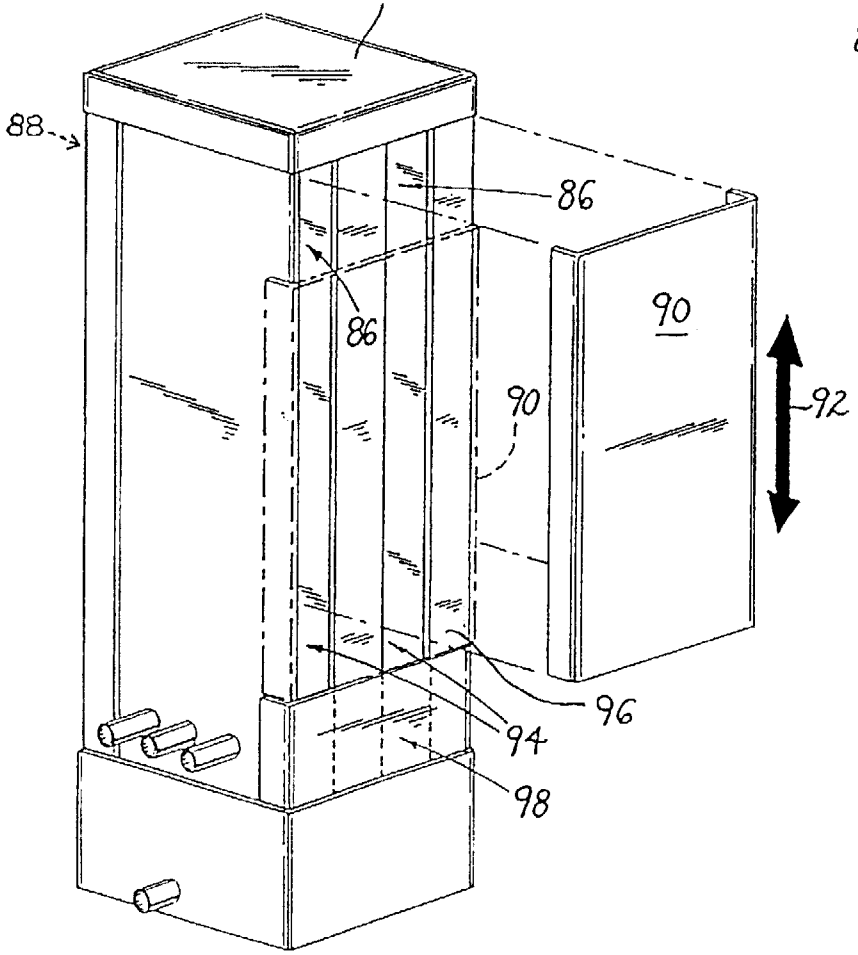
FIG. 14

REGENERATIVE HEAT EXCHANGER FOR DEHUMIDIFICATION AND AIR CONDITIONING WITH VARIABLE AIRFLOW

BACKGROUND OF THE INVENTION

1. Field of the Invention

The present invention relates to an improvement in reducing the energy requirement for dehumidifying air by providing a unitary housing which forces flowing air to be redirected for exhaust in a direction 180° from the intake direction of the airflow, and which allows a regenerative heat exchange between the intake and exhaust airstreams of an air cooling system. The invention further relates to the combination of the aforementioned heat exchanger with one or more dampers to permit selective variation of the degree of regenerative heat exchange, and therefore the degree to which the present invention provides (a) cooling, (b) dehumidification, (c) a selectable combination of cooling and dehumidifying of air being conditioned in the unit, and (d) a bypass capability whereby the regenerative heat exchange and cooling functions are bypassed.

2. Discussion of the Prior Art

Air conditioning requires relatively large amounts of energy to provide comfortable ambient indoor air under a variety of weather conditions, depending upon the climate and the season. Devices that cool and dehumidify air are well known, whereby, as the air is cooled, moisture condenses out of the air resulting in cooler, drier air being returned to the atmosphere. For the design of a dehumidifying heat exchanger, an important question is whether, and how much, heating will be applied to the air after it has been cooled for the purpose of dehumidifying it. If the cooled, and thus dehumidified air is simply exhausted into the ambient indoor space without further heating, the process is one of traditional air conditioning. However, if after dehumidification, the air is reheated before being exhausted into the ambient space, the process will be one of traditional dehumidification.

In the traditional air conditioning system, the cooling coil is controlled by ambient temperature alone, and not by ambient humidity. Thus, when ambient air rises to the temperature for which a thermostat is set, the air conditioner will engage until it is shut down by the thermostat. Temperature, and not humidity of ambient air, is the controlling factor. Similarly, traditional dehumidification is controlled by ambient humidity alone. The unit is engaged and shut down on the criterion of humidity alone.

In the prior art, there exists a number of heat exchangers utilizing a regenerative type of heat exchange airflow in which air is forced through the housing in intake channels and then redirected 180° into exhaust channels. Cooling conduits are provided so that the air passes over the conduits which are arranged perpendicular through the walls defining the channels. An example of such a regenerative heat exchanger is disclosed in U.S. Pat. No. 2,128,641 to Folsom, which discloses a dehumidifier in which the walls between the channels serve as the heat exchange surface for the air as it passes through the intake channels, over the cooling conduits, and then around the channel walls into the exhaust channels and back over the cooling conduits. The air is then exhausted back into the atmosphere through exhaust ports located adjacent to the intake ports at the first end of the unit.

U.S. Pat. No. 4,761,966 to Stark teaches cooling and reheating for dehumidification, as well as an air temperature and water temperature control system for high humidity locations. U.S. Pat. No. 2,093,968 to Kettering provides regenerative heat exchange with an integral force fan fixed within the airstream and within the confines of the device. U.S. Pat. No. 4,517,810 to Foley et al. teaches regenerative heat exchange using a "run-around loop". Canadian Patent No. 470,100 teaches the use of a corrugated plate in a heat exchange element. German Patent No. 2,400,734 teaches non-continuous corrugated separators in a counterflowing heat exchanger, while U.S. Pat. No. 3,669,186 to Schauls teaches a plate type heat exchanger having a corrugated fin fluid distributor.

In the prior art heat exchangers, there is a required large plenum space to convey the intake air to a cooling coil or to convey exhaust air leaving the cooling coil to the final pass through the regenerative heat exchanger. The large plenum space in the prior art thus could be disposed either upstream of the cooling coil or downstream of the cooling coil. Accordingly, prior art heat exchangers required a large area for installation, and also required an excessive amount of energy to force the air through the heat exchanger.

The novel heat exchanger for dehumidification and air conditioning of the present invention obviates the disadvantages associated with the prior art, by providing a unitary structure which provides for both dehumidification and air conditioning by controlling the airflow through the device. The apparatus of the present invention provides a regenerative heat exchanger with at least one cooling conduit which is associated with the heat exchanger walls defining the channels within the device. The heat exchanger walls terminate at a position adjacent a closed end of the apparatus, which defines a small plenum chamber to redirect the air 180° from the intake channels into the exhaust channels, to exit at the exhaust ports. The heat exchanger of the present invention also includes means for enhancing the regenerative heat exchanging function of the unit, thus providing a more cost efficient and compact device for installation in buildings, homes, etc.

SUMMARY OF THE INVENTION

In heat exchange systems, two airstreams are allowed to pass in channels in close proximity to each other, where the channels are separated by a heat conducting channel wall which, on one side, comprises the heat conducting channel wall for the intake airstream and on the other side comprises the heat conducting channel wall for the exhaust airstream. By so arranging the flow of air, a temperature difference between the intake air and the exhaust air provides for thermal transfer through the wall, with heat naturally flowing from the higher temperature air to the lower temperature air.

In the present invention, the apparatus may be utilized as a dehumidifier, or alternately, as an air conditioner for air cooling through the use of dampers which vary the airflow through the system. In the dehumidifier mode, intake air is pre-cooled in a regenerative heat exchanger and then further cooled through the provision of a two-pass air cooling arrangement. The air cooling process naturally condenses water vapor entrained in the intake air, which along with condensed and condensing water, flows into a condensation collection area which is part of the plenum chamber at the closed end of the apparatus. Condensing water drops into a collection area while the cooled intake air is redirected 180° from the intake direction of the airflow for a second pass through the air cooling arrangement. The exhaust airflow travels through the exhaust channels, of which at least one wall of the channel represents the wall separating the intake channel from the exhaust channel. Through this wall occurs the heat exchange process, where the cooled and dehumidified air is then warmed to return to the ambient atmosphere at a comfortable temperature.

In the air conditioning mode, the air is drawn through the intake channels and passes through the air cooling arrangement so that the air is cooled and the water vapor entrained in the intake air is condensed out of the air in the condensation collection area. The cooled and dehumidified air is then redirected 180° so that the air is further cooled by a second pass through the air cooling arrangement. In the air conditioning mode, dampers are provided which present an opening from the exhaust channels to exhaust the air before the air is warmed through the heat exchanger walls between the intake channel and the exhaust channel. The cooled air is exhausted to the environment so that a cooling effect, typically air conditioning, is achieved.

Alternately, the dampers may be provided on the intake side, so that air is drawn into the intake channels adjacent the air cooling arrangement. After passing through the air cooling arrangement, the airflow is redirected into the exhaust channels for a second pass through the air cooling arrangement. The airflow then travels through the exhaust channels to the exhaust ports for exit into the atmosphere. There is no reheating of the air in the exhaust channels since the warm air enters adjacent the air cooling arrangement. It should be noted that the device of the present invention is ambidirectional, that is the exhaust ports may be utilized as intake ports and vice versa.

The present invention utilizes temperature sensors and/or humidity sensors to variably and selectively regulate and control the temperature and the humidity of the air being exhausted from the unit. Other conventional controls may also be provided to operate the dampers to control the dehumidification or air cooling processes. Additionally, when inactive, the present invention can bypass air around the heat exchanger thereby saving energy by (a) reducing the pressure drop and subsequent fan power to move air through the entire unit, and (b) reducing the amount of evaporization from wetted surfaces that typically occurs after a cooling coil shuts down and warmer air is introduced.

The apparatus of the present invention includes the heat exchanger walls which separate the channels and are provided in a channel box terminating in the chamber which forces the air to make what is essentially a "U-turn" which substantially prevents diffusion of the airflow velocity. The plenum space needed for conveying airflow between the cooling arrangement and the heat exchanger walls is greatly reduced, since the heat exchanger walls define the intake channels and the exhaust channels. The heat exchanger walls are spaced apart at a fixed distance and are maintained at that distance by separating means such as spacers or serpentine corrugations. The heat exchanger walls extend to also serve as fins for the heat exchange surface of the cooling system comprising a pumped fluid coolant flowing through at least one cooling conduit. The coolant is any conventional coolant circulated through the cooling conduits, where the conduits may penetrate and traverse the heat exchanger near or substantially at the plenum chamber at the end of the channel box. The cooling conduits preferably are disposed to run substantially perpendicular to the heat exchanger walls, but alternately may be provided in the same plane as the heat exchanger walls so that the conduits are mechanically secured to the heat exchanger walls, by means such as a press-fit, welding, and brazing, or the conduits may be integrally formed with the walls during fabrication.

The apparatus of the present invention is adaptable to provide dehumidification, in what is essentially a two pass air cooling and reheating arrangement, or to provide air conditioning, in what comprises a two pass cooling arrangement with little or no reheating. The dehumidification feature feeds air through the intake channels past the air cooling arrangement and into the lower chamber which redirects the air into the exhaust channels. The air is then directed past the air cooling arrangement a second time in the exhaust channels, and then is reheated on its way to the exhaust ports. The air conditioning feature permits the air to exit subsequent to the second pass of the air cooling arrangement, but prior to reheating in the exhaust channels.

As the air is redirected in the plenum chamber from the intake channels to the exhaust channels, the air enters the exhaust channels at virtually the same airflow speed, so that the velocity profile, i.e. the intake airflow speed versus the exhaust airflow speed, is essentially constant to optimize the counterflow regenerative heat exchange.

As stated above, the present invention provides for both dehumidification, air cooling, and any condition therebetween, through the provision of dampers which are movable with respect to the intake ports and the exhaust ports to selectively vary the functionality of the apparatus. In addition, bypass dampers may be provided that allows flowing air to bypass the intake channels, the exhaust channels, the cooling system, and the plenum chamber when the air cooling arrangement is inactive. This airflow bypass capability thereby allows for reducing the energy for fan power and drastically reducing evaporation from wetted surfaces, making the device very efficient.

In order to enhance the efficiency of the heat exchange occurring between the intake channels and the exhaust channels of the device of the present invention, it is preferred that the material comprising the heat exchanger walls be constructed of a material having good heat exchange or heat conducting properties, such as aluminum. However, due to the size of the walls, i.e., the length and width of the walls, as well as air pressure differences, aluminum tends to be flexible and may warp or bend along its length, thus restricting the flow of air in some of the channels. In order to prevent this, the present invention provides a novel spacing arrangement to maintain the spacing between the walls which define the heat exchanger walls between the channels. The spacers may take the form of heat conductive posts or tubes which are positioned at various locations along the length of the heat exchanger walls. Alternately, a corrugated structure may be provided which bridges the distance between the heat exchanger walls along their length to maintain good thermal contact between the air flowing through the heat exchanger apparatus and the heat exchanger walls between the channels. These corrugations may be formed of the same material as the heat exchanger walls, or may be provided of a suitable heat conductive or heat exchange material.

In order to enhance the cooling aspect of the device, it is also contemplated that additional fins be provided in the vicinity of the cooling conduit at the closed end of the device of the present invention. The additional fins increase the surface area of the cooling arrangement so that water vapor in the air passing over the cooling conduit may be condensed with greater efficiency.

In addition, due to high velocities of the airflow in the intake and exhaust channels of the device of the present invention, it is possible that condensed water may be drawn into the exhaust channels where it will be heated and evaporate in the regenerative heat exchanger contrary to the desired result. To reduce this effect at higher airflow velocities, it is possible to modify the fin spacing, such that the heat exchanger wall spacing of the intake and exhaust channels at the point where these channels terminate may be modified by pinching the fin spacing at the ends of the intake channels and flaring the fin spacing on the exhaust channels. This will enhance condensation at the ends of the intake channels by increasing slightly the velocity of the air as it exits the intake channels, while at the same time slightly slowing the velocity of the air entering the exhaust channels to prevent condensate from entering the exhaust channels to be evaporated and returned to the atmosphere. However, in this embodiment, the device of the present invention may be used in a manner in which airflow is permitted in only one direction in order for the unit to function properly. If the heat exchanger walls are not pinched and flared, the flow of air may be in either direction and the unit will operate as intended for both the dehumidification process and the air conditioning process.

The present invention provides a thermally regenerative heat exchange system for dehumidification and conventional air cooling which is embodied in a novel unitary apparatus which reduces the physical space formerly required for installation of prior art devices. The compact size and unitary nature of the present invention, in turn, makes it less expensive to manufacture and possible to install in many buildings and structures where larger units known in the prior art could not be conventionally utilized. The compact size and unitary nature of the present invention renders it ideal for retrofitting and/or upgrading air conditioning systems.

BRIEF DESCRIPTION OF THE DRAWINGS

The foregoing features of the present invention will become more readily apparent and may be understood by referring to the following detailed description of an illustrative embodiment of the heat exchanger for dehumidification and air conditioning and its novel variable airflow feature, taken in conjunction with the accompanying drawings, in which:

FIG. 7 illustrates a perspective view of an alternate embodiment of the heat exchanger of FIG. 2 showing an airflow plenum chamber arranged at a first end of the heat exchanger;

FIG. 8*a* illustrates a perspective view in partial cutaway of the baffle arrangement of the plenum chamber of FIG. 7;

FIG. 8*b* illustrates a schematic airflow diagram of the heat exchanger of FIG. 7;

FIG. 9*a* illustrates a perspective view in partial cutaway of an alternate airflow plenum chamber positioned at the first end of the heat exchanger of FIG. 7;

FIG. 9*b* illustrates a schematic airflow diagram of the heat exchanger of FIG. 9*a;*

FIG. 10 illustrates the heat exchanger of FIG. 7 having a damper in the airflow plenum chamber arranged at the first end of the heat exchanger;

FIG. 11*a* illustrates a perspective view in partial cutaway of the damper assembly of the airflow plenum chamber of FIG. 10 with the damper in the closed position;

FIG. 11*b* illustrates a schematic airflow diagram with the damper in the position shown in FIG. 11*a;*

FIG. 12*a* illustrates a perspective view in partial cutaway of the damper arrangement of FIG. 10 with the damper in the open position;

FIG. 12*b* illustrates a schematic airflow diagram with the damper in the position shown in FIG. 12*a;*

FIG. 13 illustrates a perspective view in partial cutaway of an alternate heat exchanger according to the present invention having a slidable damper on an outside wall thereof;

FIG. 13*a* illustrates a schematic airflow diagram of the heat exchanger of FIG. 13 with the slidable damper in the lower position;

FIG. 13*b* illustrates a schematic airflow diagram of the heat exchanger of FIG. 13 with the slidable damper in the upper position;

FIG. 14 illustrates an alternate embodiment of the heat exchanger of FIG. 13;

FIG. 14*a* illustrates a schematic airflow diagram of the heat exchanger of FIG. 14 with the slidable damper in the lower position;

FIG. 14*b* illustrates a schematic airflow diagram of the heat exchanger of FIG. 14 with the slidable damper in the upper position;

DETAILED DESCRIPTION OF THE PREFERRED EMBODIMENTS

Figure 1:
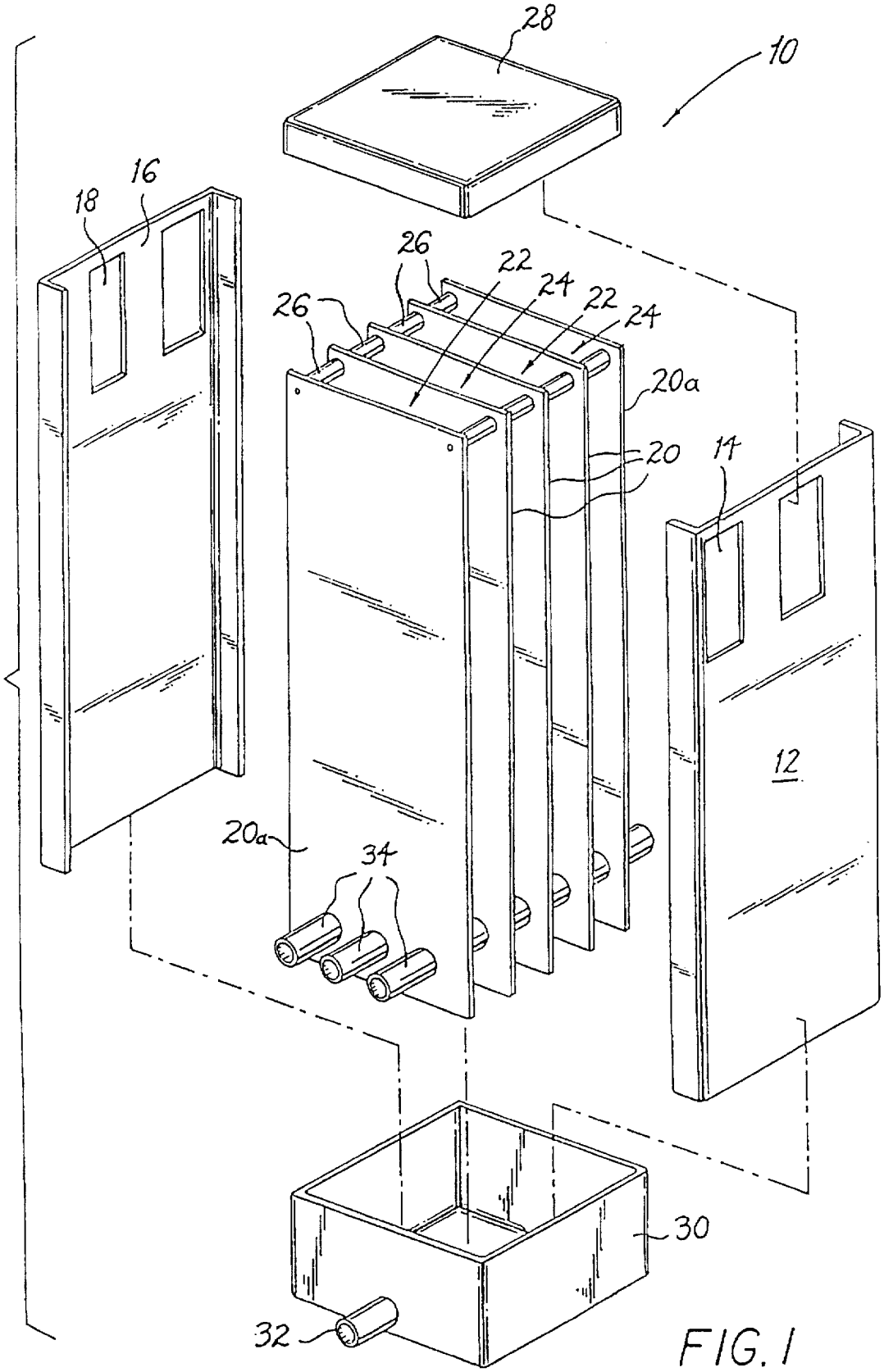
FIG. 1 illustrates an exploded perspective view of a first embodiment of the heat exchanger of the present invention.

Referring now to the drawings, in which like reference numerals identify similar or identical elements throughout the several views, FIG. 1 illustrates a first embodiment of the heat exchanger for dehumidification and air conditioning in accordance with the present invention. In its simplest form, heat exchanger 10 conditions the air in a dehumidification process by removing moisture or humidity from the air as it circulates through the device. The air is cooled in the intake channels and returned to the atmosphere through the exhaust channels. As the air enters the device, it is cooled, first by passing through the heat exchanger and then by passing over conduits which carry a coolant material so that the moisture in the air condenses and is subsequently removed from the air. As the air is returned to the atmosphere through the exhaust channels, the air is reheated through a heat exchange process and returned to the atmosphere as drier and thus more comfortable ambient air. As will be explained below, the present invention may be utilized to dehumidify air in an efficient manner as well as to cool air and function as a typical air conditioner to lower temperature within the environment in which it is used.

The heat exchanger 10 of FIG. 1 includes a front panel 12 having intake ports 14 and a back panel 16, which includes exhaust ports 18. Front panel 12 and rear panel 16 enclose the channel box assembly which is comprised of a plurality of channel walls 20 and which includes exterior or side walls 20*a*. It is of course contemplated that an additional exterior panel, similar to panels 12 and 16 may be provided as the exterior side walls, but for purposes of simplicity and cost efficiency, channel side walls 20*a* serve the dual function of being an exterior wall, as well as a channel wall.

Figure 16:
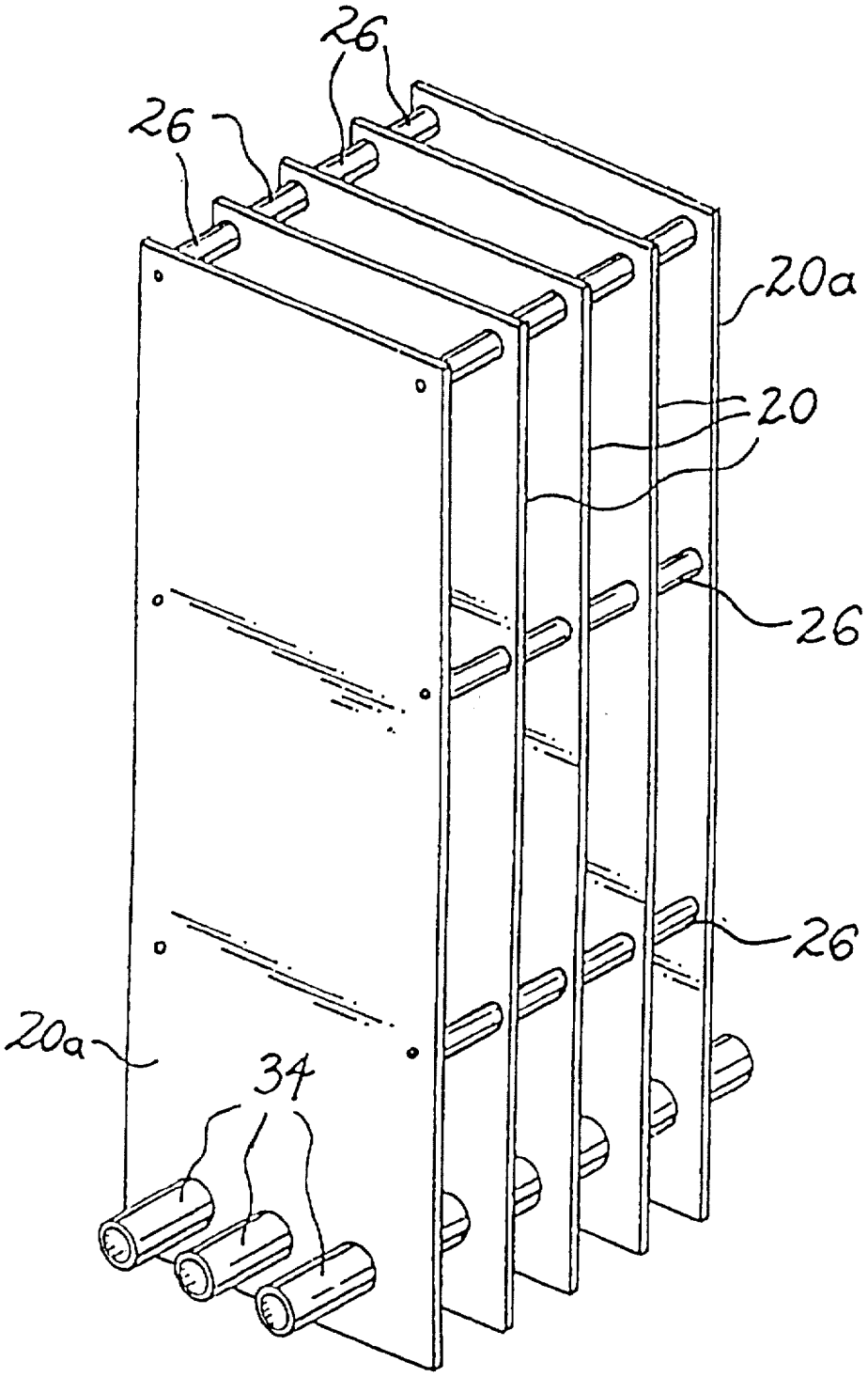
FIG. 16 illustrates a perspective view of the channel wall assembly of the heat exchanger of FIG. 1 having a plurality of heat conducting spacers positioned along the length of the channel walls.

Channel walls 20 are preferably constructed of a material having excellent heat transfer or heat conducting properties, and in particular may be constructed of aluminum or a suitable thin plastic material. The length and width of channel walls 20 is determined by the particular installation in which the heat exchanger 10 will be utilized, and the number of channel walls is likewise determined by the particular need. For purposes of simplicity, heat exchanger 10 is shown having five channel walls 20, thus defining four channels, two intake channels 22 and two exhaust channels 24 whose function will be described below. The channel walls are maintained in fixed space relation by spacers 26, which are preferably constructed of a material having good heat transfer or heat conducting characteristics in order to enhance the heat transfer between the channels and through the channel walls. As seen in FIG. 16, it may be desirable, in applications where the length and width of the channel walls 20 is large, to provide a plurality of spacers 26 at various locations throughout the length and width of the channel walls 20 in order to lend both stability to the walls to prevent warping or flexing, particularly during heat transfer processes, as well as to enhance the heat transfer characteristics of the channel box in the heat exchanger 10.

Figure 2:
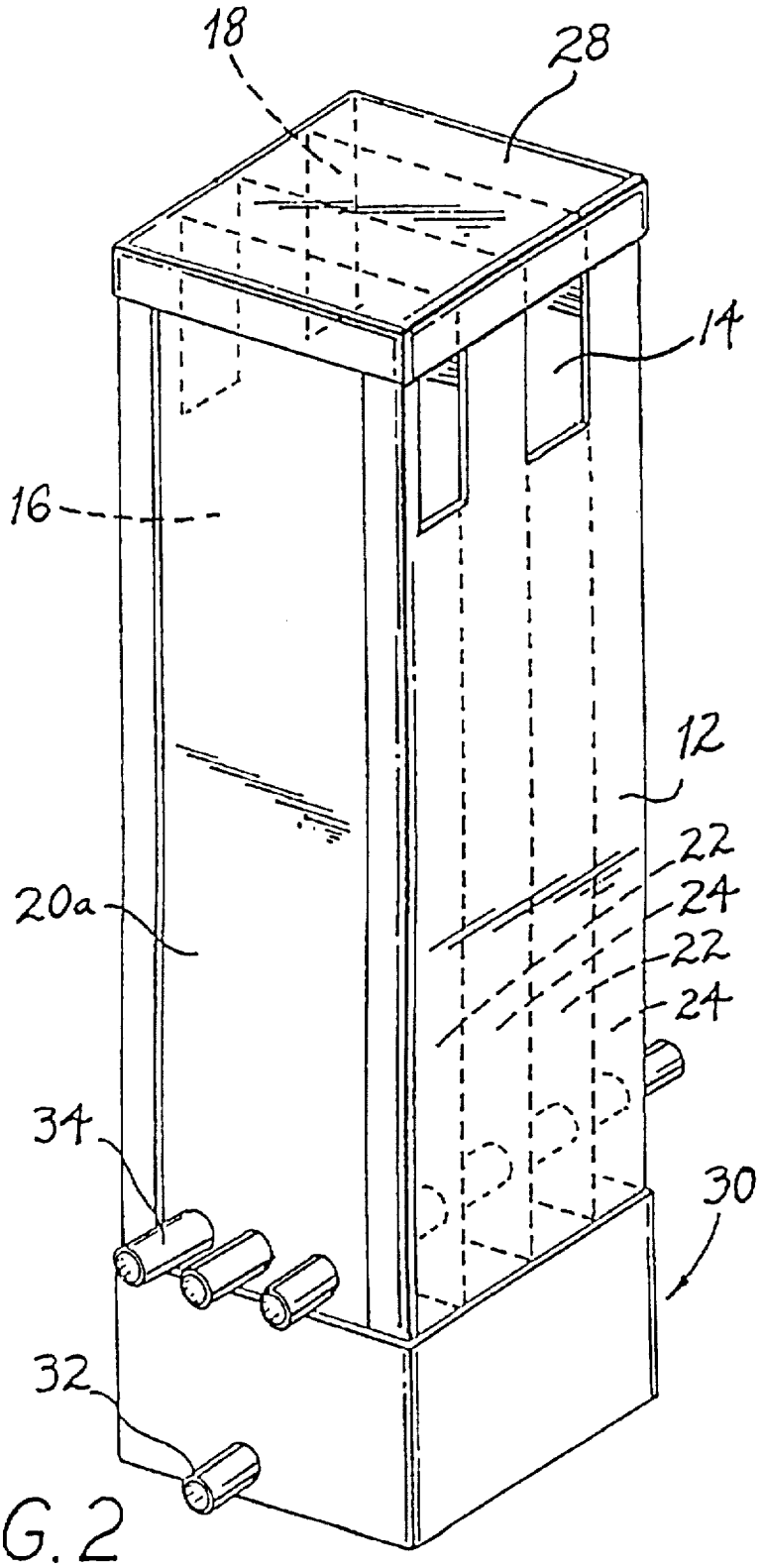
FIG. 2 illustrates a perspective view of the heat exchanger of FIG. 1 in the assembled condition.
Figure 3:
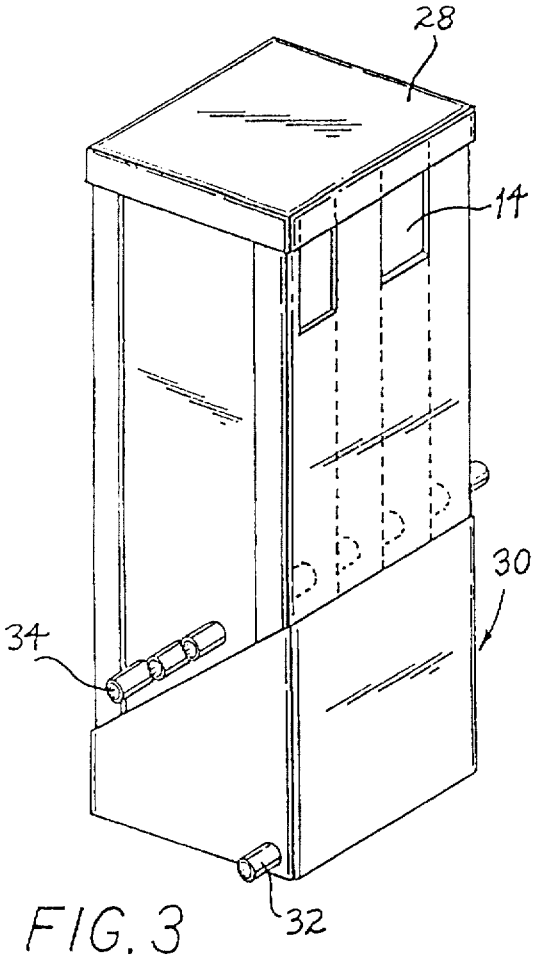
FIGS. 3–6 illustrate perspective views of alternate embodiments of the heat exchanger of FIG. 2.
Figure 4:
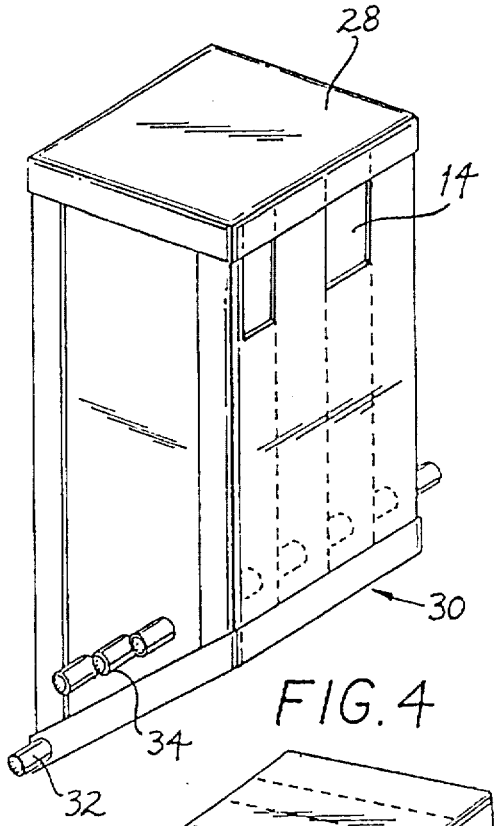
Figure 5:
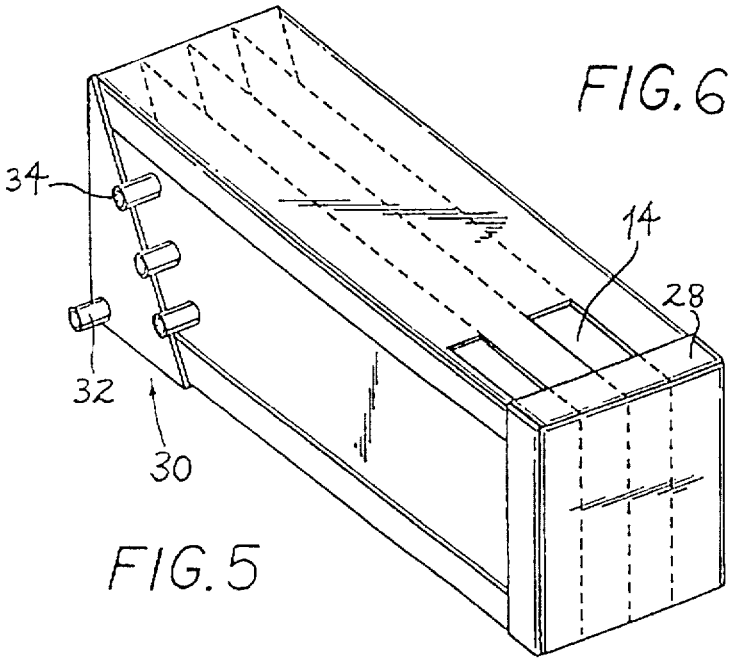
Figure 6:
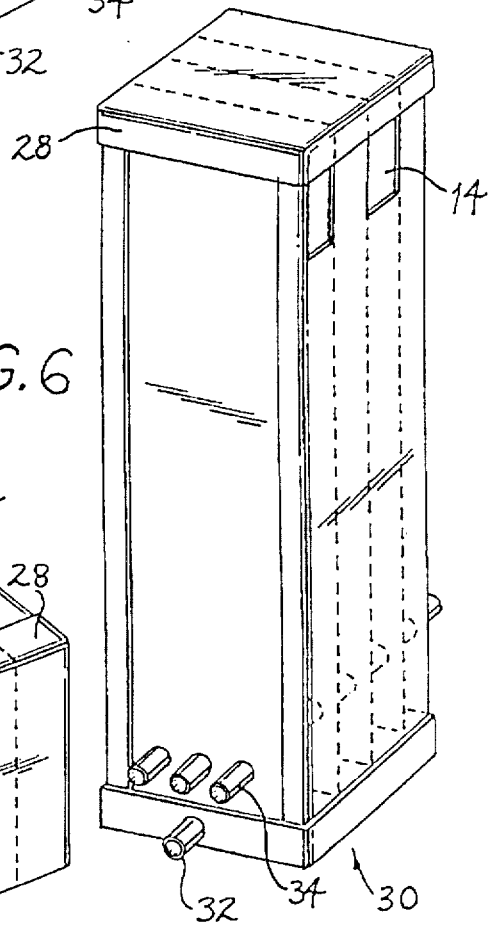

The heat exchanger 10 is assembled as shown in FIG. 2 with a top cover 28 and a redirecting plenum chamber 30 located at the bottom of the unit. For purposes of this discussion, the "top" of the heat exchanger 10 refers to the end of the heat exchanger adjacent to the intake ports and exhaust ports, while the "bottom" of the heat exchanger 10 refers to the end of the device having the redirecting plenum chamber. Likewise, the terms "front" and "back" refer to the intake side and the exhaust side, respectively. As will be described below, the present invention is ambi-directional, i.e., the device will function equally as well if the intake ports function as exhaust ports, and vice versa, depending upon the position of the fan which forces the air through the heat exchanger 10.

Located at the bottom of the unit adjacent the redirecting plenum chamber 30 are the coolant conduits 34, which carry a conventional refrigerant or coolant, such as chilled water or brine, which serves to cool the air passing through the intake channels and the exhaust channels. Also located at the bottom of the heat exchanger 10, preferably positioned on the redirecting plenum chamber 30 is a drain plug 32 which permits water which is condensed out of the airstream to be drained from the system.

Redirecting plenum chamber 30 provides a small space between the ends of the channel walls 20 and the bottom of the heat exchanger 10, which in effect forces the air which passes into the redirecting plenum chamber 30 through the intake channels 22 to be redirected 180° in a "U-turn" manner to exit through the exhaust channels. The air enters heat exchanger 10 through intake ports 14 where it travels down intake channels 22, thus heating the channel walls 20 it passes over as it travels towards the redirecting plenum chamber 30. The air at this point is effectively "pre-cooled", as the heat from the air passes to the channel walls 20. As the airstream encounters the cooling conduits 34, it is further cooled as it passes into the redirecting plenum chamber 30. The air is then redirected 180° from the intake channels 22 into the exhaust channels 24, where the air again encounters the cooling conduits to be further cooled. It is this cooling process which condenses water vapor entrained in the air so that water accumulates in the bottom of redirecting plenum chamber 30 and may be removed from the system through drain plug 32. As the cold, drier air moves through the exhaust channels 24, the channel walls 20 warm the air due to the heat conducting characteristics of the walls 20. With the warm air on one side of the channel walls 20 in the intake channels 22, the cooled air is warmed in the exhaust channels 24 through a heat exchange process to be returned to the ambient environment as warmed, drier, and thus more comfortable, dehumidified air.

The heat exchanger 10 of the present invention is of course utilized with a dehumidification and air conditioning system which includes, among other things, humidity sensors and temperature sensors to determine the temperature at which the air is returned to the environment, and a fan which determines the force of the airstream passing through the system of heat exchanger 10. The present invention permits the selective dehumidification or air conditioning process to provide either drier air back to the environment or cooler air back to the environment, or a combination of both.

The minimal amount of spacing from the bottom of the channel walls 20 to the end wall formed by the redirecting plenum chamber 30 redirects the air 180° so that it returns towards the top of the heat exchanger 10 through the exhaust channels 24. FIGS. 3–6 show alternate constructions of the heat exchanger 10 in which the redirecting plenum chamber 30 may be constructed in a plurality of configurations. In each case, the channel walls 20 terminate adjacent the bottom wall of the redirecting plenum chamber 30 to require the air to be redirected 180° in a "U-turn" fashion to return to the exhaust ports 18. All that is required is a minimal amount of spacing between the lower ends of the walls 20 and the bottom wall of the redirecting plenum chamber 30.

FIGS. 3–6 illustrate different constructions based upon the particular installation requirements of the heat exchanger 10.

FIG. 7 illustrates a second embodiment of the heat exchanger of the present invention, in which an airflow plenum chamber 36 is provided to accommodate installation of the heat exchanger 10 in a duct-type system. Airflow plenum chamber 36 is positioned at the top of heat exchanger 10 and extends from front wall 12 and back wall 16 to form a hood-type cover. An intake passage 38 is provided which communicates intake air with intake ports 44, which permits forced air to enter the intake channels 22. Airflow plenum chamber 36 is also provided with an exhaust passage 40, similar in construction to intake passage 38 which communicates with exhaust ports 46. Separating the intake passage 38 and the exhaust passage 40, and consequently separating the intake ports 44 and the exhaust ports 46, is a baffle wall 42, which in the embodiment of FIGS. 7 and 8 prevents the flow of air through the airflow plenum chamber 36 from the intake passage 38 directly to the exhaust passage 40.

As seen in FIGS. 8*a* and 8*b*, as air enters through intake passage 38, it enters the heat exchanger 10 at intake ports 44. The air is forced through intake channels 22, thus warming the channel walls 20 as the air travels towards the cooling conduits 34 and the redirecting plenum chamber 30. As the air moves through heat exchanger 10 and passes over the cooling conduits, water vapor entrained in the air is condensed out of the air and collected as described above in redirecting plenum chamber 30. As the air enters the redirecting plenum chamber, it is redirected 180° into the exhaust channels and travels back towards the top of the device to exit at the exhaust ports 46. As the air is redirected in the plenum chamber 30, it passes over the cooling conduits 34 a second time to further cool the air as it enters the exhaust channels 24. As the air passes through the exhaust channels 24, as described above, it is reheated through the transfer of heat through the channel walls 20 which raises the temperature of the air so that it is returned to the environment through the exhaust ports 46 as warmed and drier, dehumidified air. The path of the airflow is best seen in FIG. 8*b*, which shows the air entering intake passage 38 and exiting exhaust passage 40 so that the airflow is from point A to point B through the heat exchanger.

As best seen in FIG. 8*a*, the intake channels 22 are sealed at the exhaust passage 40 by channel blocking members 45, and likewise the exhaust channels 24 are sealed at the intake passage 38 by channel blocking members 47. This ensures that airflow enters the intake ports 44, travels as shown in FIG. 8*b* through the intake channels 22 and exits the exhaust channels 24 via the exhaust ports 46.

FIGS. 9*a* and 9*b* illustrate an alternate airflow plenum chamber 48 located at the top end of the heat exchanger in a manner similar to that shown in FIG. 7. In this embodiment, angled baffles 50 are provided which permit the intake of air from two sides of the heat exchanger as shown. Intake passages 54 are provided to permit the airflow to enter into the intake channels 22 through intake ports 58 from both sides of the heat exchanger. The airflow is in a direction from point C to point D as shown in FIG. 9*b*, such that the air enters intake passages 54 and exits exhaust passage 56. Exhaust passage 56 communicates with the exhaust channels 24 through the provision of exhaust ports 60. Blocking members are provided to seal the exhaust channels at the intake passage 54 and to seal the intake channels at the exhaust passage 56.

FIGS. 10–12 show an alternate construction of the airflow plenum chamber 62 located at the top end of the heat exchanger. Airflow plenum chamber 62 includes a novel bypass damper arrangement 64 which permits the heat exchanger to operate as a dehumidifier, or to provide for a bypass feature to allow air to pass through the airflow plenum chamber without entering the heat exchanger channel box. This permits bypassing of the system to eliminate starting and stopping of the fan during times when the air has been dehumidified to a desired extent, and permits the fan to operate without encountering the pressure drop associated with the force required to blow the air through the heat exchanger itself. In this situation, the cooling conduits are not required to circulate the cooling fluid since the air bypasses the heat exchanger system, thus eliminating reevaporation of moisture from the wetted surfaces, and providing an energy-efficient alternative to the system. It is of course contemplated that bypass damper arrangement 64 is controlled by sensors so that the damper is opened and closed as needed.

As seen in FIG. 10, airflow plenum chamber 62 includes an intake passage 70 and an exhaust passage 72, which are separated by the bypass damper arrangement 64. Bypass damper arrangement 64 includes the damper baffle 66, which opens and closes the damper passage 68. As seen in FIG. 11*a* when the damper baffle 66 is in the closed position, air enters the intake passage 70 and enters the heat exchanger through intake ports 74. FIG. 11*b* illustrates the airflow which travels from point A to point B. The air enters the system as described above, through the intake channels 22 and passes over the cooling conduits until it is redirected into the exhaust channels 24 at the redirecting plenum chamber 30. The air is cooled a second time as it passes by the cooling conduits 34 to condense the entrained water vapor from the air, and then the air is warmed as it passes through the exhaust channels through the heat exchange process at the channel walls. The air exits the exhaust channels at exhaust port 76 and through exhaust passage 72.

When the humidity sensors indicate that the dehumidification process has reached the desired level, the damper baffle 66 is moved to the open position thus opening the damper passage 68. In this case, the airflow travels from point E to point F as shown in FIG. 12*b*, bypassing the heat exchanger and permitting the air to flow directly from intake passage 70 through the damper passage 68 and exit at the exhaust passage 72.

Each of the embodiments described above with respect to FIGS. 1–12 describe the system for use as a dehumidifier. Maximum dehumidification occurs when the air enters the system at the top of the unit and travels through the system in the intake channels 22 and over the cooling conduits 34 to condense the water vapor entrained in the air at the cooling conduits 34. The air is then redirected into the exhaust channels 24 and back over the cooling conduits 34. As the air passes through the system, it is reheated through the heat exchange process through the channel walls. The air is then returned to the system through the exhaust ports 18 as warmed, drier, and thus more comfortable air.

Figure 15A:
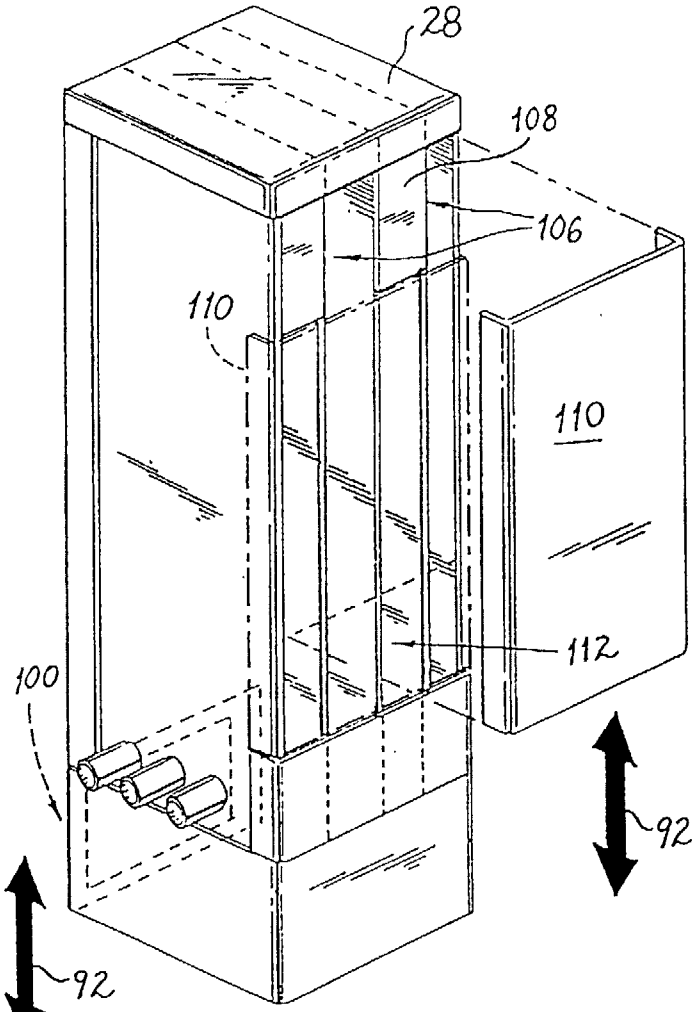
FIG. 15*a* illustrates a rear perspective view of the heat exchanger of FIG. 15.
Figure 15:
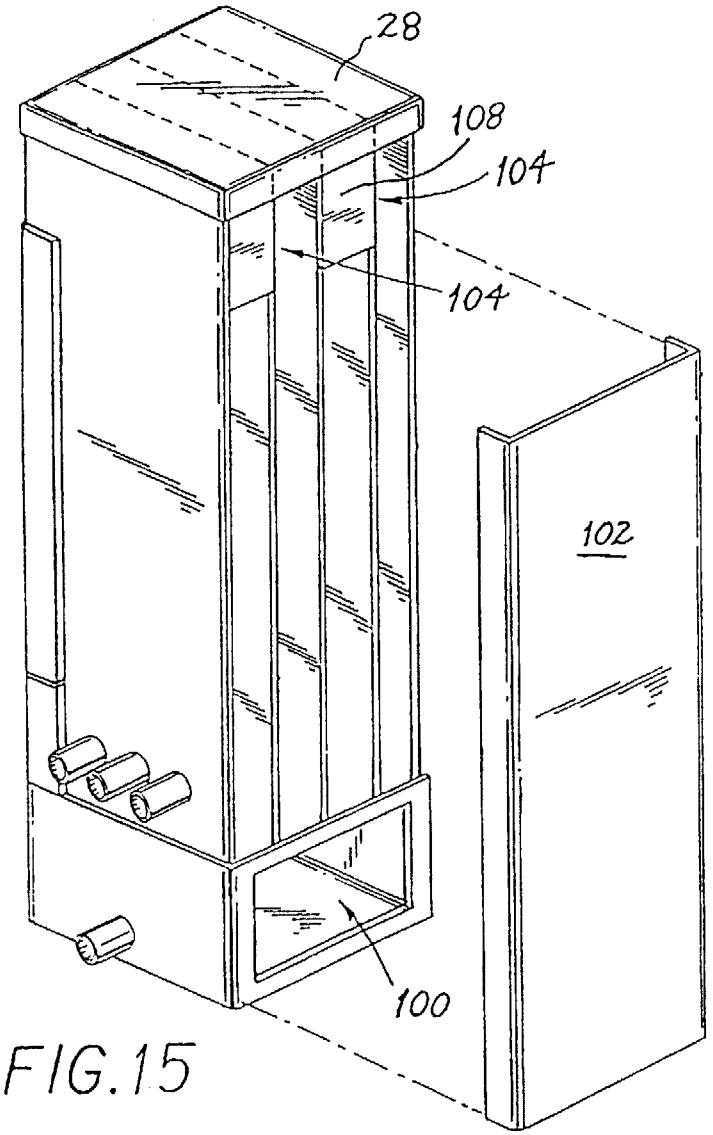
FIG. 15 illustrates a front perspective view of an alternate embodiment of the heat exchanger of FIG. 14 having a pair of full ports which communicate all the channels together, and having a pair of slidable dampers for opening and closing the ports.

FIGS. 13–15 will now be described which illustrate the use of the heat exchanger 10 either as a dehumidifier, or alternately as an air conditioner for cooling air. FIG. 13 illustrates the heat exchanger of the present invention, similar to that described above, which further includes a slidable damper 90 which allows the heat exchanger to be used as a dehumidifier or as an air cooling system. In this embodiment, an airflow plenum chamber 78 is provided which is similar to that described above. Airflow plenum chamber 78 includes an intake passage 82 and an exhaust passage 84 which are separated by a baffle wall 80. As seen in FIG. 13, upper intake ports 93 are positioned within intake passage 82 and communicate the intake channels 22 with the intake passage 82. Blocking members 96 are provided to close off the exhaust channels 24 on the intake side of the device. At the bottom of the heat exchanger 10, adjacent the plenum chamber 30, a front wall piece 98 is provided and provides a termination point for the slidable damper 90. Slidable damper 90 is movable in the direction of arrow 92 and permits heat exchanger 10 to be utilized either as an air cooling system or a dehumidification system.

Turning to FIG. 13*a*, there is shown heat exchanger 10 being operated as a dehumidification system where the direction of airflow is from point A to point B, similar to that described above. When slidable damper 90 is moved in the downward direction as shown by arrow 92 towards the redirecting plenum chamber 30, the lower portion of slidable damper 90 will abut front wall piece 98 to close medial intake ports 94 and in effect, open intake passage 82 to permit the air to enter the upper intake ports 93 so that the heat exchanger 10 functions as a dehumidifier as described above. The air enters intake passage 82 and the intake channels 22 through the upper intake ports 93 and exits exhaust passage 84 from the exhaust channels 24 through exhaust ports 88.

To utilize the heat exchanger as an air conditioner to cool the air, slidable damper 90 is moved upward as shown by the arrow 92 in FIG. 13*b*, which in effect closes the intake passage 82 and opens the medial intake ports 94. The direction of the airflow is from point G to point H as shown in FIG. 13*b*, which provides for maximum air cooling by forcing the air through the medial intake ports 94 so that it passes directly over the cooling conduits so that it is cooled immediately, and enters the redirecting plenum chamber 30 to be redirected and forced back through the exhaust channels 24 so as to pass over the cooling conduits 34 a second time. This maximum cooled air is then exhausted through exhaust passage 84 as cooled air with little or no reheating so that the heat exchanger 10 functions as a typical air conditioner to cool the air.

FIG. 14 illustrates an alternate construction of the present invention utilizing the heat exchanger constructed in accordance with FIG. 2. In this embodiment, the airflow plenum chamber is eliminated and top cover 28 is provided, such that intake ports 86 are provided on the side of the front wall 12 in accordance with FIG. 2. In this embodiment, slidable damper 90 is movable as shown from the position in FIG. 14*a*, in which the slidable damper 90 is moved in the direction of arrow 92. In this figure, it is seen that slidable damper 90 covers medial intake ports 94 so that upper intake ports 86 are open and air is fed into the heat exchanger in the direction of arrow A at intake ports 86. As shown in FIG. 14*a*, heat exchanger 10 operates in the same manner as that described above with respect to FIGS. 2 and 3. The airflow direction, as shown in FIG. 14*a* is from point A to point B, and the system operates for maximum dehumidification, resulting in warmed, drier, more comfortable air being returned to the environment.

As seen in FIG. 14*b*, when slidable damper 90 is moved in the direction of arrow 92 in an upward direction, intake ports 86 are closed and medial intake ports 94 are opened, resulting in the airflow moving from point G to point H, such that the air enters medial intake ports 94, passes over cooling conduits 34, is redirected from the intake channels 22 into the exhaust channels 24 within the redirecting plenum chamber 30, is further cooled as it passes back over the cooling conduits 34 and exits the system at exhaust ports 88 as cooled air. As shown in FIG. 14*b*, heat exchanger 10 functions as an air conditioner for cooling the air to provide for maximum cooling.

FIG. 15 illustrates an alternate embodiment of the heat exchanger of the present invention which selectively provides for maximum dehumidification and maximum air cooling by providing a pair of slidable dampers 102 and 110 on the front wall and back wall of the heat exchanger, respectively. FIG. 15 illustrates the front of the heat exchanger in which slidable damper 102 is movable to cover upper intake ports 104 as well as a full port 100 in plenum chamber 30. Full port 100 permits airflow into both the intake channels 22 and the exhaust channels 24 simultaneously, thus bypassing the redirecting feature of the plenum chamber 30. Port 100, when opened, permits airflow in the same direction through both the intake channels 22 and the exhaust channels 24 to permit maximum cooling in a most cost efficient and economical manner. Using the full port 100 provides a reduction in air pressure and permits a large volume of air to pass over the cooling conduits 34 and to be exhausted through a medial exhaust port 112 as fully cooled air. Medial port 112 is also, preferably, a full port, so that the air drawn through port 100 in both intake channels 22 and exhaust channels 24 exits through full port 112 without obstruction.

As stated above, FIG. 15 illustrates the front of the device and shows slidable damper 102 covering the full port 100, while leaving open intake ports 104. Channel blocking members 108 close off the exhaust channels at the top and a top cover 28 is provided as described above. FIG. 15*a* illustrates the rear of the heat exchanger, and shows slidable damper 110 in position to cover medial exhaust ports 112, which is a full port also, while providing for open exhaust ports 106. Blocking members 108 close off the intake channels as described above. Both slidable damper 102 and slidable damper 110 are movable in the direction of arrow 92.

Figure 15B:
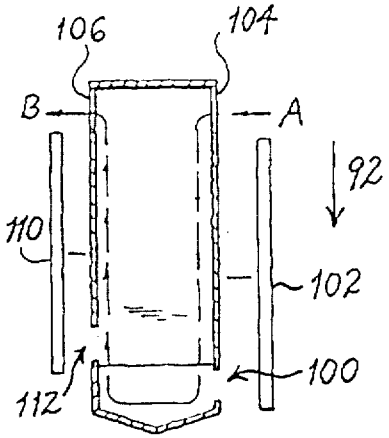
FIG. 15*b* illustrates a schematic airflow diagram of the heat exchanger of FIG. 15 in which both dampers are in the lower position.
Figure 15C:
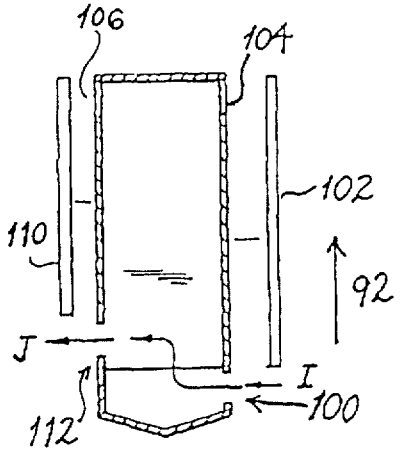
FIG. 15*c* illustrates a schematic airflow diagram of the heat exchanger of FIG. 15 with both dampers in the upper position.

FIG. 15*b* shows the airflow schematic for maximum dehumidification, in which both slidable dampers 102 and 110 are moved in the direction of arrow 92 to their lower position to close medial exhaust port 112 and full port 100. In doing so, intake ports 104 and exhaust ports 106 are opened, thus permitting maximum dehumidification with airflow from point A to point B in a manner as described above. FIG. 15*c* shows slidable dampers 102 and 110 moved in the direction of arrow 92 to the upper portion of the heat exchanger, thus opening full port 100 and medial exhaust port 112 to permit airflow in the direction from point I to point J to provide for maximum cooling.

Figure 15D:
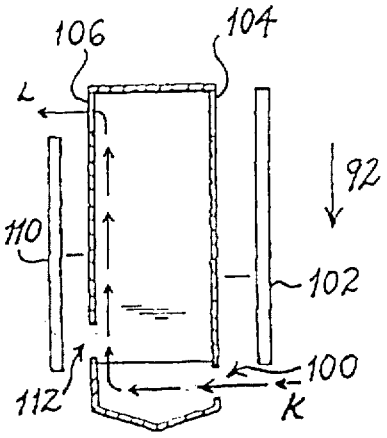
FIG. 15*d* illustrates a schematic airflow diagram of the heat exchanger of FIG. 15 with one damper in the upper position and one in the lower position.
Figure 15E:
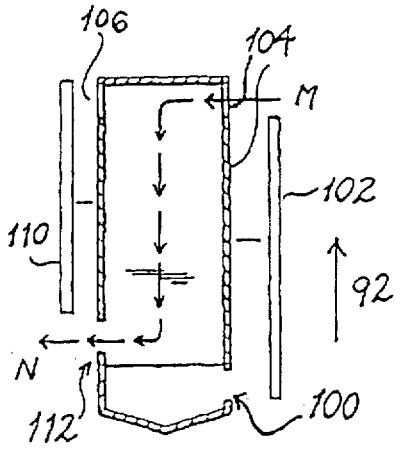
FIG. 15*e* illustrates a schematic airflow diagram of the heat exchanger of FIG. 15*d* with the dampers in opposite positions.

It is of course contemplated that slidable dampers 102 and 110 are independently adjustable, and may be utilized independent of each other to adjust for varying dehumidification and varying air cooling depending upon the installation of the heat exchanger and its conditions of use. Accordingly, as seen in FIG. 15*d*, slidable damper 102 may be in the up position to open full port 100 and close intake ports 104, while slidable damper 110 may be in the down position to close medial exhaust port 112 and open exhaust ports 106. This would provide for air cooling, and airflow would be in the direction from point K to point L. When slidable damper 102 is in the down position to close full port 100 and thus open intake ports 104 as seen in FIG. 15*e*, and when slidable damper 110 is in the up position to open medial exhaust full port 112 and thus close upper exhaust ports 106, the heat exchanger would be in a bypass mode, since the airflow would be in the direction from point M to point N. This arrangement would avoid the cooling conduits 34, permitting the unit to operate more cost-efficiently since the cooling conduits would be off. Depending on the conditions of use, slidable dampers 102 and 110 may be adjustable to provide for cooling and/or dehumidification.

The embodiment of FIG. 16, as described above, enhances the regenerative heat exchange process by providing heat conductive spacers 26, which serve the dual purpose of maintaining the spacing between the channel walls 20 and enhancing the heat exchange process through the channel walls. These spacers may have any shape and may be provided at regular intervals or irregular intervals between the channel walls. As the air passes over the spacers, the spacers aid in the heat conduction to or from the channel walls and thus provide for an enhanced heat exchange process.

Figure 17:
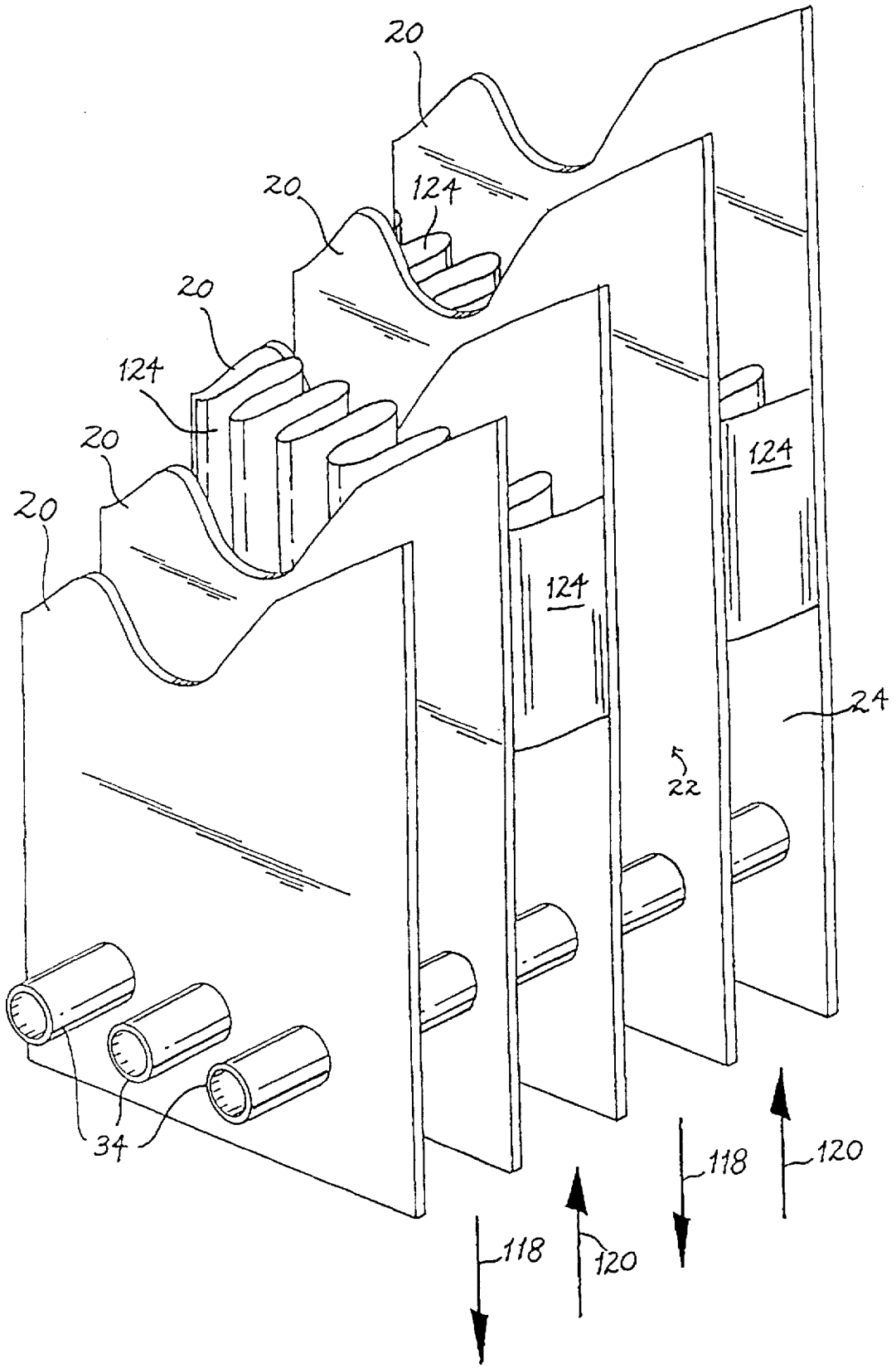
FIG. 17 illustrates a perspective view in partial cutaway of the channel wall assembly having a plurality of corrugated fins to enhance heat transfer positioned between the heat exchanger walls.

FIG. 17 illustrates an alternate means of enhancing the heat transfer characteristics of the heat exchanger through the provision of corrugated fins 124 which are placed between the channel walls 20. The corrugated fins 124 are preferably constructed of a material having good heat conducting characteristics and are positioned in the embodiment shown in FIG. 17 in the exhaust channels 24. It is of course contemplated that the corrugated fins may be provided throughout the length of the channels, and may also be provided in both the intake channels 22 and the exhaust channels 24. The corrugated fins enhance the heat transfer between the walls and serve the dual function of maintaining the spacing between the walls while at the same time enhancing heat conduction between the walls. Alternately, the corrugated fins may also be constructed as a series of bridge members, i.e., bars that extend between the channel walls to enhance the heat transfer characteristics of the walls as well as to maintain the spacing between the walls. As shown in FIG. 17, the airflow in the intake channels 22 is in the direction of arrows 118, and the airflow in the exhaust channels is in the direction of arrows 120.

Figure 18:
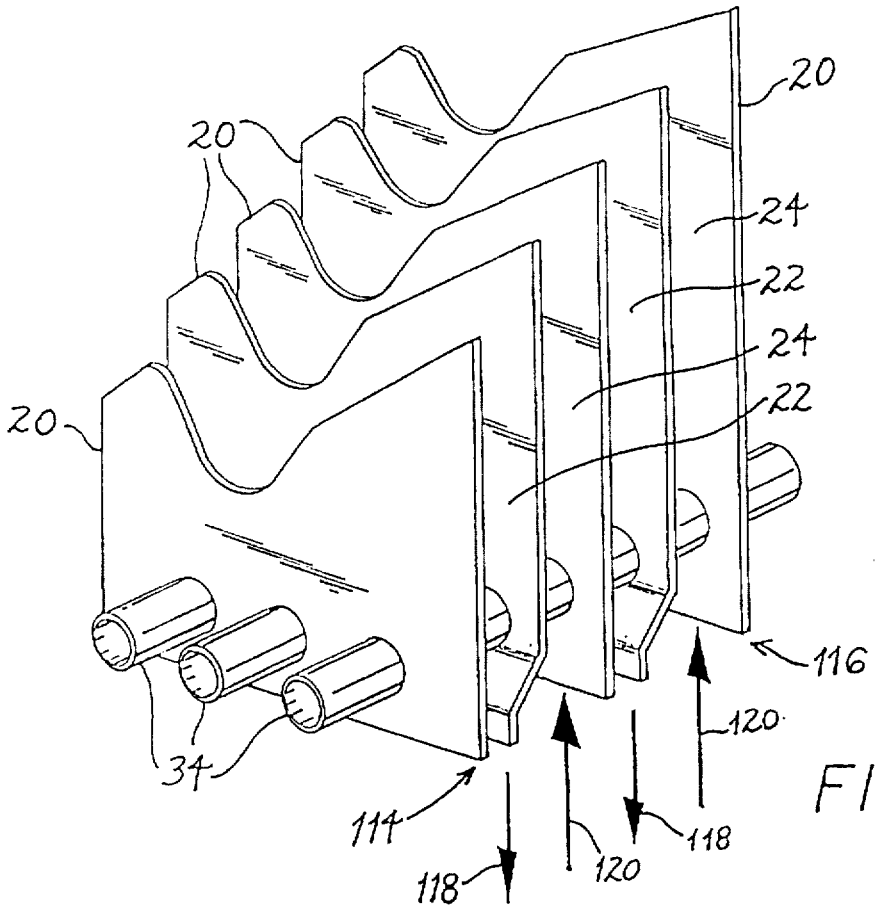
FIG. 18 illustrates a perspective view in partial cutaway of the lower end of the heat exchanger walls showing pinching and flaring of the walls.

FIG. 18 illustrates a means for compensating for high velocity airflow. In some systems, where the airflow velocity is very high, the airstream in the intake channels enters the redirecting plenum chamber 30 at such a velocity that some of the water vapor which is entrained in the airstream is not condensed out as the airstream passes over the cooling conduits 34 in the intake channels. As the airstream travels in the direction of arrow 118, it enters the plenum chamber 30 and is then redirected 180° back into the exhaust channels 24 in the direction of arrows 120. As the airstream encounters the cooling conduits 34, some water vapor may be carried into the exhaust channels 24 and is not condensed out due to the high velocity of the airflow. In order to compensate for this, the intake channels are pinched as at 114 and the exhaust channels are flared as at 116, thus permitting the air to be slowed somewhat to reduce carry-over of condensation into the exhaust channels and to increase the efficiency of the system.

Figure 19A:
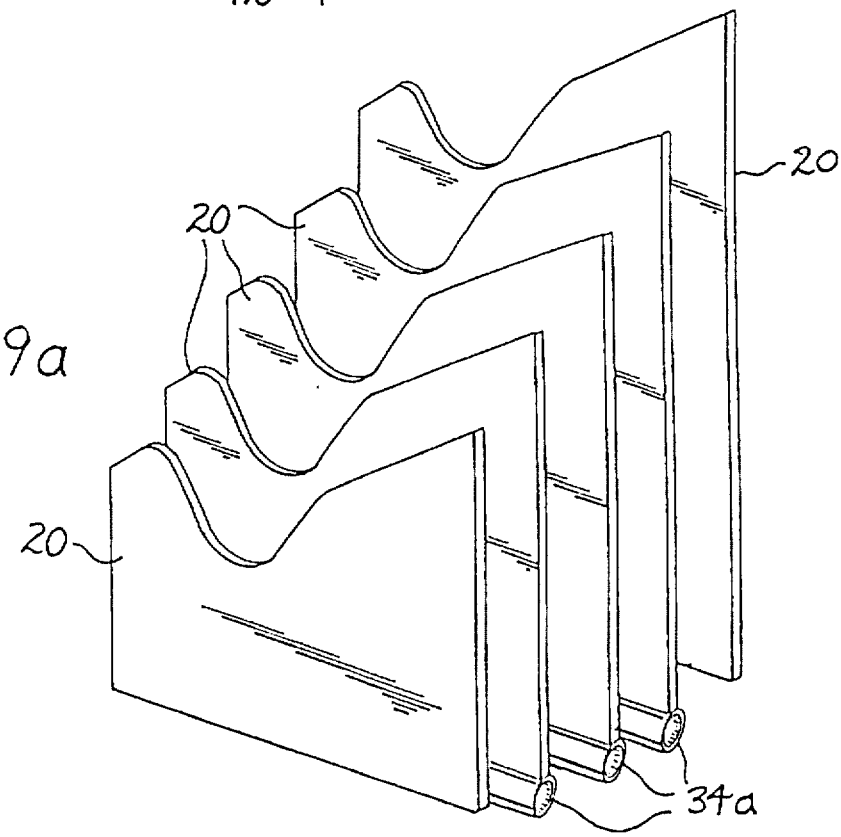
FIG. 19*a* illustrates a perspective view in partial cutaway of the heat exchanger walls showing an alternate arrangement of the cooling conduits.
Figure 19B:
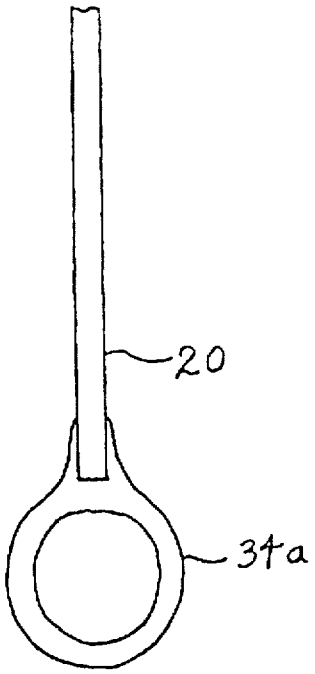
FIGS. 19*b* and 19*c* illustrate side elevational views of the heat exchanger walls showing alternate arrangements for the cooling conduits.
Figure 19C:
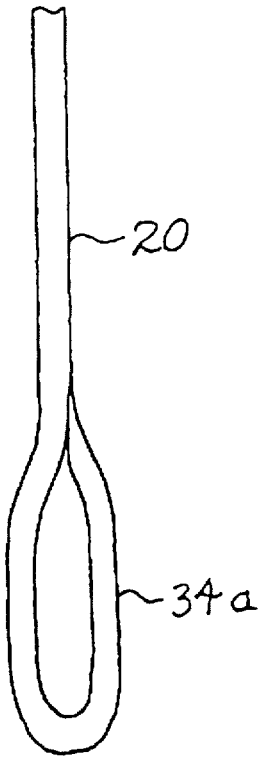

FIG. 19*a* illustrates an alternate construction of the cooling conduits 34 in which they are provided at the lower end of the channel walls 20. In this embodiment, it is contemplated that the cooling conduits 34*a* may be brazed or welded directly to the ends of the channel walls, or they may be mechanically secured by a press-fit arrangement as shown in FIG. 19*b*. The conduits may also be integrally formed on the walls as shown in FIG. 19*c*. The cooling conduits 34 may be provided as tubular conduits, or may be flattened in the direction of airflow to reduce airflow resistance and to increase the surface area, and therefore increase the efficiency of the cooling process to condense water vapor out of the airstream.

Figure 20:
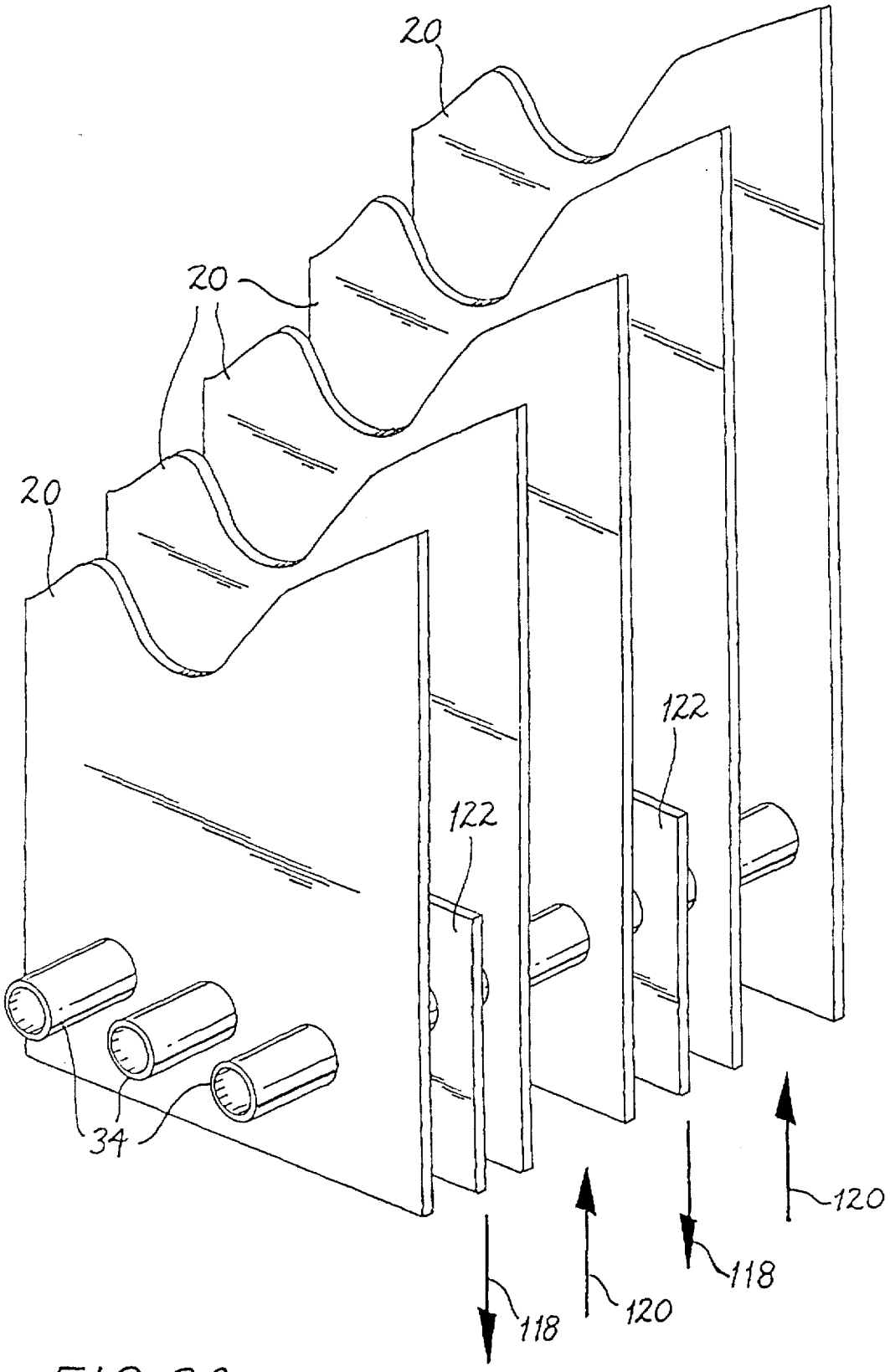
FIG. 20 illustrates a perspective view in partial cutaway of the heat exchanger walls having cooling fins positioned at the lower end of the channel walls.

FIG. 20 illustrates a means for enhancing the cooling process to condense water out of the airstream. In this embodiment, cooling fins 122 are provided to increase the surface area of cooling and are positioned in the intake channels to encounter the airflow in the intake channels which is in the direction of arrows 118. It is of course contemplated that similar cooling fins may be provided in the exhaust channels to encounter the airflow in the direction of arrows 120.

Figure 21:
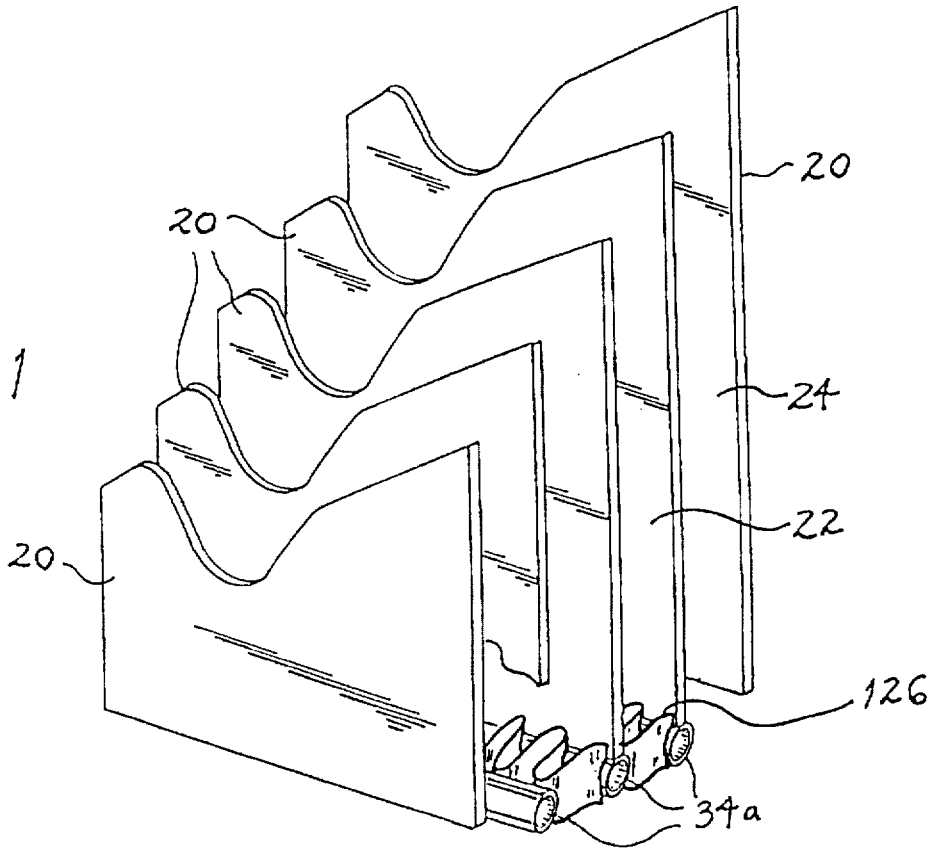
FIG. 21 illustrates a perspective view in partial cutaway of the heat exchanger walls showing the cooling conduit arrangement of FIG. 19 having corrugated cooling fins positioned between the cooling conduits to enhance cooling of the airstream.

It is also contemplated that the embodiments of FIGS. 16–20 are not mutually exclusive, and may be provided in any combination to enhance the efficiency of the heat exchanger of the present invention. As such, FIG. 21 illustrates the cooling conduit arrangement of FIG. 19 having corrugated fin members 126 positioned between the conduits 34*a*. This construction enhances the cooling process and facilitates condensation of water vapor from the airstream in channels 22 and 24.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A heat exchanger for use in a system for conditioning an airstream, the system including sensors for measuring temperature and humidity and including a fan for forcing air through the heat exchanger, comprising:

a housing having a proximal end and a distal end, at least the distal end being closed and defining a plenum chamber for redirecting the airstream;

at least one heat conducting wall located within said housing defining channels for passage of the airstream, alternating ones of said channels being sealed from each other at the proximal end of said housing and along a length thereof and being in fluid communication with each other at the closed distal end of said housing;

at least one intake port located adjacent the proximal end of said housing and being in fluid communication with at least one of said channels to define an intake channel;

at least one exhaust port located adjacent the proximal end of said housing and being in fluid communication with at least one other of said channels to define an exhaust channel, said exhaust port being sealed from said intake port at the proximal end but being in fluid communication with said intake port through said redirecting plenum chamber at the closed end of said housing;

at least one cooling conduit carrying coolant fluid located adjacent the distal end of said housing and being in thermal contact with said at least one channel wall and with the airstream in said channels;

at least one medial port located adjacent said cooling conduit intermediate the proximal end and the distal end, said medial port being in fluid communication with one of said channels; and a damper movable between a first position in which said medial port is closed and said intake port and said exhaust port are open, and a second position in which said medial port is open and one of said intake port and said exhaust port is closed and another is open;

wherein said heat exchanger dehumidifies the airstream when said damper is in the first position by cooling the airstream as it passes over said cooling conduit in said intake channel, redirecting the airstream in said plenum chamber into said exhaust channel for further cooling to condense water vapor from the airstream, and reheating the airstream in said exhaust channel by a heat exchange process through said heat conducting channel wall with the airstream in said intake channel; and further wherein said heat exchanger cools the airstream when said damper is in the second position by cooling the airstream as it passes over said cooling conduit in said intake channel, redirecting the airstream in said plenum chamber into said exhaust channel for further cooling to condense water vapor from the airstream, and exhausting the airstream from said heat exchanger without reheating.

2. A heat exchanger according to claim 1, wherein said damper is movable with respect to said intake port and said medial port, said medial port being in fluid communication with said intake channel.

3. A heat exchanger according to claim 1, wherein said damper is movable between said exhaust port and said medial port, said medial port being in fluid communication with said exhaust channel.

4. A heat exchanger according to claim 1, further comprising an airflow plenum chamber disposed at the proximal end of said housing including an intake passage in fluid communication with said intake port and an exhaust passage in fluid communication with said exhaust port, said airflow plenum chamber having a baffle movable between a first position in which said baffle sealingly separates said intake passage from said exhaust passage to direct the airstream into said intake port, and a second position in which said baffle communicates said intake passage with said exhaust passage and seals said intake port, to bypass said heat exchanger by directing the airstream through said airflow plenum chamber from said intake passage to said exhaust passage.

5. A heat exchanger according to claim 2, further comprising a medial exhaust port in fluid communication with said exhaust channel and an exhaust damper movable with respect to said exhaust port at the proximal end and said medial exhaust port, said dampers being selectively positionable with respect to said ports to provide selective dehumidification and air cooling.

6. A heat exchanger according to claim 1, further comprising a plurality of heat conducting walls defining a plurality of alternating intake channels and exhaust channels, said intake channels being in fluid communication with intake ports and said exhaust channels being in fluid communication with exhaust ports at the proximal end of said housing.

7. A heat exchanger according to claim 6, further comprising support means for maintaining said plurality of walls in substantially uniform spaced relation, said support means further enhancing heat transfer between said walls to facilitate the heat exchange process.

8. A heat exchanger according to claim 7, wherein said support means maintain said walls in spaced, parallel relation.

9. A heat exchanger according to claim 7, wherein said support means comprises a plurality of members which bridge said channels and enhance thermal contact between said walls.

10. A heat exchanger according to claim 7, wherein said support means comprises a corrugated fin arrangement disposed in at least one of said channels to bridge said walls and enhance thermal contact therebetween.

11. A heat exchanger according to claim 6, further comprising a plurality of cooling conduits passing substantially perpendicularly through said walls, and including a plurality of cooling fins positioned in said channels and secured to said cooling conduits to enhance condensation of water vapor from the airstream.

12. A heat exchanger according to claim 6, further comprising a plurality of cooling conduits integral with said walls and extending in substantially the same plane as said walls at the distal end.

13. A heat exchanger for use in a system for conditioning an airstream through dehumidification and/or cooling of the airstream, the system including sensors for measuring temperature and humidity and including a fan for forcing air through the heat exchanger, comprising:

a housing having a proximal end and a distal end, at least the distal end being closed and defining a plenum chamber for redirecting the airstream;

a plurality of heat conducting walls located within said housing defining alternating intake channels and exhaust channels for passage of the airstream, said channels being sealed from each other at the proximal end and along a length thereof and being in fluid communication with each other at said plenum chamber at the distal end of said housing;

a plurality of intake ports corresponding in number to said intake channels and being in fluid communication therewith, said intake ports being located adjacent the proximal end of said housing;

a plurality of exhaust ports corresponding in number to said exhaust channels and being in fluid communication therewith, said exhaust ports being located at the proximal end of said housing, and being sealed from said intake ports at the proximal end but in fluid communication with said intake ports through said plenum chamber at the distal end of said housing;

a plurality of cooling conduits carrying coolant fluid integral with said channel walls at distal ends thereof and extending in substantially the same plane as said walls; and corrugated cooling fin members extending between said channel walls at said cooling conduits so as to be positioned in said channels in thermal contact with said cooling conduits and the airstream to facilitate condensation of water vapor from the airstream to maximize cooling of the airstream.

* * * * *